US007604578B2

(12) United States Patent
Liu

(10) Patent No.: US 7,604,578 B2
(45) Date of Patent: Oct. 20, 2009

(54) ADJUSTABLE DUMBBELL SYSTEM

(76) Inventor: Ping Liu, No. 8 Oianyingfang Street, Taiyuan, Shanxi (CN)

( * ) Notice: Subject to any disclaimer, the term of this patent is extended or adjusted under 35 U.S.C. 154(b) by 0 days.

(21) Appl. No.: 12/228,335

(22) Filed: Aug. 12, 2008

(65) Prior Publication Data

US 2009/0042700 A1 Feb. 12, 2009

Related U.S. Application Data

(63) Continuation-in-part of application No. 11/900,852, filed on Sep. 13, 2007, now Pat. No. 7,452,312, which is a continuation-in-part of application No. 11/494,248, filed on Jul. 27, 2006, now Pat. No. 7,285,078.

(51) Int. Cl.
*A63B 21/072* (2006.01)
*A63B 21/075* (2006.01)

(52) U.S. Cl. ..... 482/108; 482/106

(58) Field of Classification Search ..... 482/106–109; D21/680–682

See application file for complete search history.

(56) References Cited

U.S. PATENT DOCUMENTS 6,500,101 B1 * 12/2002 Chen ..... 482/107
6,540,650 B1 * 4/2003 Krull ..... 482/107
6,776,741 B2 * 8/2004 Burwell ..... 482/108
7,137,932 B2 * 11/2006 Doudiet ..... 482/107
7,261,678 B2 * 8/2007 Crawford et al. ..... 482/107
7,285,078 B1 * 10/2007 Liu ..... 482/108
7,413,533 B2 * 8/2008 Lin ..... 482/108
7,452,312 B2 * 11/2008 Liu ..... 482/108
2003/0199368 A1 * 10/2003 Krull ..... 482/106
2004/0005968 A1 * 1/2004 Crawford et al. ..... 482/106

* cited by examiner

*Primary Examiner*—LoAn H. Thanh
*Assistant Examiner*—Allana Lewin

(57) ABSTRACT

A handle has opposed ends and a central extent. A grip rotationally receives the central extent of the handle. An adjustment wheel is secured to each end of the handle. A side cover is fixedly secured to each end of the grip. A dowel disk is on the handle adjacent to one side cover with fingers and spaces. A plurality of cam bits are supported on the handle. A safety lock is within the side cover adjacent to the dowel disk. The safety lock has a first end extent and a second end extent with a radial recess and a central extent with an axial projection. A coil spring within the radial recess urges the safety lock radially outwardly.

4 Claims, 47 Drawing Sheets

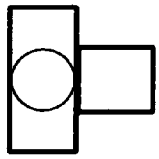
FIG .19E
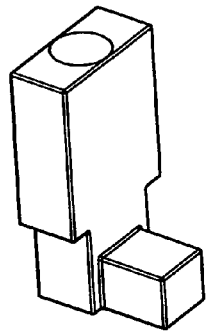
FIG .19A
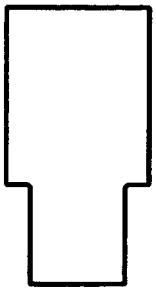
FIG .19D
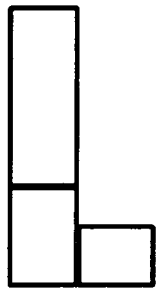
FIG .19C
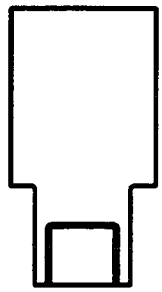
FIG .19B
FIG .19

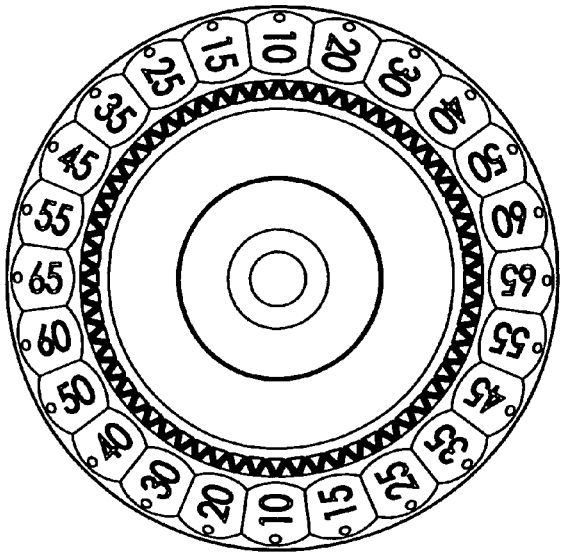
FIG .26B
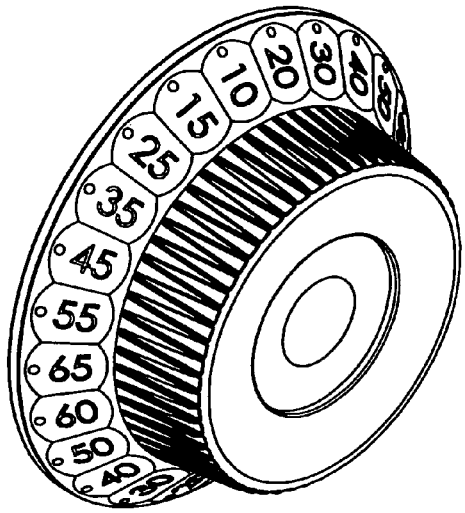
FIG .26A
FIG .26

ADJUSTABLE DUMBBELL SYSTEM

RELATED APPLICATIONS

This U.S. Patent Application is a continuation-in-part of U.S. patent application Ser. No. 11/900,852 filed Sep. 13, 2007 and issued Nov. 18, 2008 as U.S. Pat. No. 7,452,312, which is a continuation-in-part of U.S. patent application Ser. No. 11/494,248 filed Jul. 27, 2006 and issued Oct. 23, 2007 as U.S. Pat. No. 7,285,078, the subject matter of which applications is incorporated herein by reference.

BACKGROUND OF THE INVENTION

1. Field of the Invention

The present invention relates to an adjustable dumbbell system and more particularly pertains to selectively varying the weight to be lifted by a user, such selective varying being done in a safe, convenient and economical manner.

2. Description of the Prior Art

The use of exercise weight systems of known designs and configurations is known in the prior art. More specifically, exercise weight systems of known designs and configurations previously devised and utilized for the purpose of varying weight through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,261,678 issued Aug. 28, 2007 to Crawford relates to an Adjustable Dumbbell System and U.S. Pat. No. 6,540,650 issued Apr. 1, 2003 to Krull relates to a Weight Selection Method and Apparatus.

While these devices fulfill their respective, particular objectives and requirements, the aforementioned patents do not describe an adjustable dumbbell system that allows for selectively varying the weight to be lifted by a user, such selective varying being done in a safe, convenient and economical manner.

In this respect, the adjustable dumbbell system according to the present invention substantially departs from the conventional concepts and designs of the prior art, and in doing so provides an apparatus primarily developed for the purpose of selectively varying the weight to be lifted by a user, such selective varying being done in a safe, convenient and economical manner.

Therefore, it can be appreciated that there exists a continuing need for a new and improved adjustable dumbbell system which can be used for selectively varying the weight to be lifted by a user, such selective varying being done in a safe, convenient and economical manner. In this regard, the present invention substantially fulfills this need.

SUMMARY OF THE INVENTION

In view of the foregoing disadvantages inherent in the known types of exercise weight systems of known designs and configurations now present in the prior art, the present invention provides an improved adjustable dumbbell system. As such, the general purpose of the present invention, which will be described subsequently in greater detail, is to provide a new and improved adjustable dumbbell system and method which has all the advantages of the prior art and none of the disadvantages.

To attain this, the present invention essentially comprises an adjustable dumbbell system for selectively varying the weight to be lifted by a user. Such selective varying is done in a safe, convenient and economical manner. The system comprises a dumbbell having a handle in a cylindrical configuration with a central axis. The handle has opposed ends and a central extent. A tubular grip with opposed ends rotationally receives the central extent of the handle. An adjustment wheel is secured to each end of the handle for rotating the handle with respect to the grip. A side cover is fixedly secured to each end of the grip, a dowel disk is rotatably supported on the handle adjacent to one side cover. The dowel disk has radially extending fingers each about 5 mm in width equally spaced from the central axis with spaces each about 8 mm in width between the fingers. A plurality of cam bits are supported on the handle between the side covers and the adjustment wheels, the cam bits are secured on each side of the side covers for concurrent rotation with the handle.

Provided next are a plurality of weights, one weight for each cam bit. Each weight has openings and each cam bit has a cam surface whereby the weights are adapted to attach to and release from an associated cam bit as a function of the rotational orientation of the shaft and adjustment wheels. Each weight has a central primary aperture and primary slot. Each weight has a major section and an axially offset secondary minor section. The minor section is formed with a secondary aperture and a secondary slot. Each cam plate includes an irregularly shaped polygon with radially enlarged sections providing cam surfaces at maximum radii greater than the radii of the remainder of the cam plate. The radially enlarged sections are adapted to releasably couple selectively with the secondary aperture of the weights.

Lastly, a safety lock is radially positioned for reciprocable movement within the side cover adjacent to the dowel disk. The safety lock has an upper extent with an exposed button and a lower extent with a radial recess and a central extent with an axial projection. The axial projection is about 4.5 mm in width. A coil spring is within the radial recess and urges the safety lock upwardly and radially outwardly. The safety lock is movable between a raised locked orientation and a lowered unlocked orientation.

The safety lock when in the raised locked orientation positions the axial projection in a space between adjacent fingers of the dowel disk for allowing only limited rotation of the dowel disk, cam bits, handle and adjustment disks with respect to the side covers, safety lock and grip. In this manner, the user may not change the weight to be lifted with the lifting of the dumbbell. The safety lock when in the lowered unlocked orientation positions the axial projection radially spaced from the fingers and spaces of the dowel disk for allowing full rotation between the dowel disk, cam bits, handle and adjustment disks with respect to the side covers, safety lock and grip. In this manner, the user may change the weight to be lifted with the lifting of the dumbbell.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable dumbbell system which has all of the advantages of the prior art exercise weight systems of known designs and configurations and none of the disadvantages.

It is another object of the present invention to provide a new and improved adjustable dumbbell system which may be easily and efficiently manufactured and marketed.

It is further object of the present invention to provide a new and improved adjustable dumbbell system which is of durable and reliable constructions.

An even further object of the present invention is to provide a new and improved adjustable dumbbell system which is susceptible of a low cost of manufacture with regard to both materials and labor, and which accordingly is then susceptible of low prices of sale to the consuming public, thereby making such adjustable dumbbell system economically available to the buying public.

Even still another object of the present invention is to provide an adjustable dumbbell system for selectively varying the weight to be lifted by a user, such selective varying being done in a safe, convenient and economical manner.

Lastly, it is an object of the present invention to provide a new and improved adjustable dumbbell system. A handle has opposed ends and a central extent. A grip rotationally receives the central extent of the handle. An adjustment wheel is secured to each end of the handle. A side cover is fixedly secured to each end of the grip. A dowel disk is on the handle adjacent to one side cover with fingers and spaces. A plurality of cam bits are supported on the handle. A safety lock is within the side cover adjacent to the dowel disk. The safety lock has a first end extent and a second end extent with a radial recess and a central extent with an axial projection. A coil spring within the radial recess urges the safety lock radially outwardly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

Detailed description on each part of the invention shall be provided for reference.

FIG. 7 is a front view after cutting away FIG. 1. It is a drawing without dumbbell sheets shown on.

FIG. 19A is a 3D view of the safety locks and is prepared in light of the current invention.

FIG. 19B is the right view of the safety locks.

FIG. 19C is the front view of the safety locks.

FIG. 19D is the left view of the safety locks.

FIG. 19E is the top view of the safety locks.

FIG. 26A is a 3D view of the dumbbell handwheels and is prepared in light of the current invention.

FIG. 26B is the front view of the dumbbell handwheels and is prepared in light of the current invention.

The same reference numerals refer to the same parts throughout the various Figures and throughout the various embodiments.

DESCRIPTION OF THE PREFERRED EMBODIMENT

Figure 1:
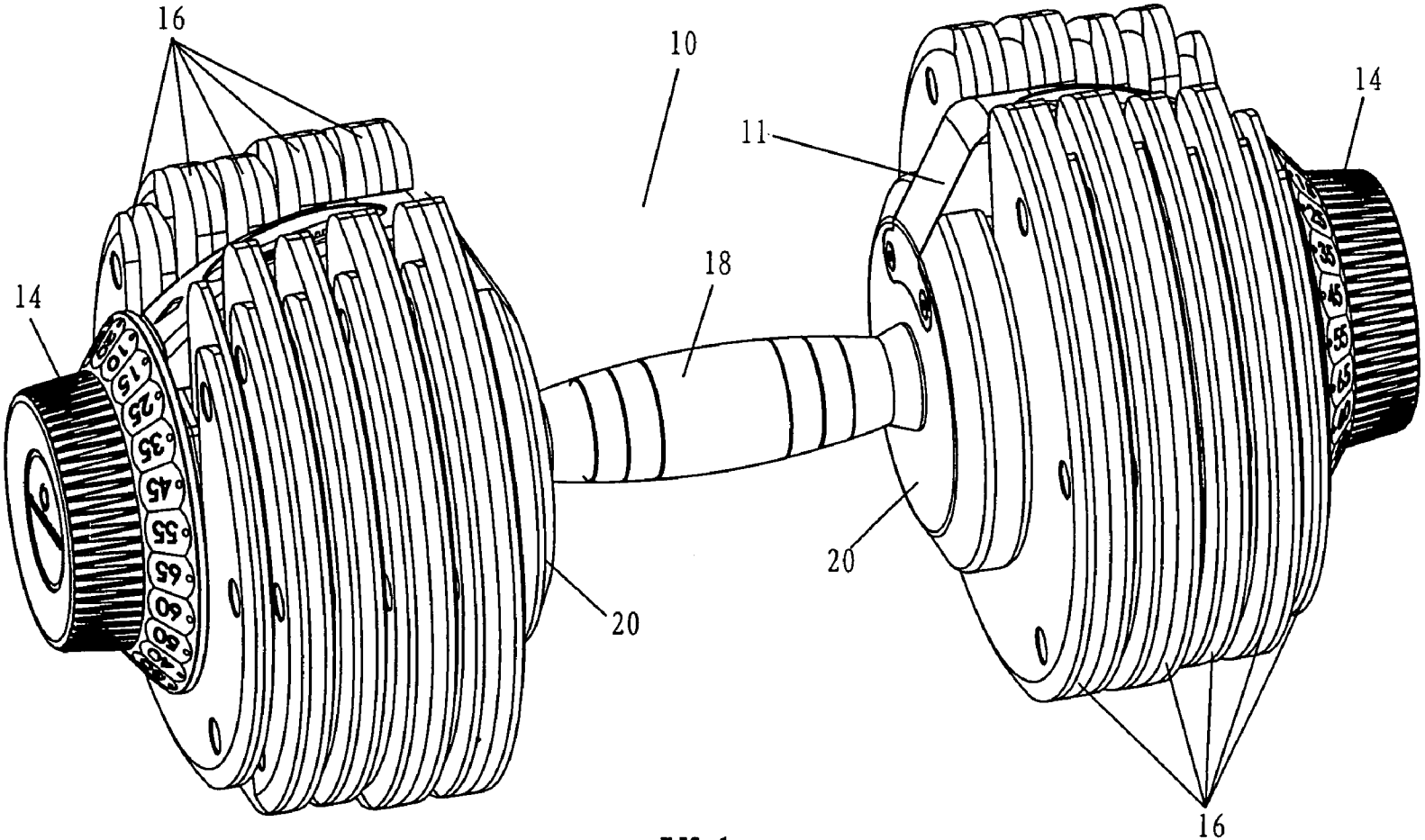
FIG. 1 is a drawing of the equal size of the adjustable dumbbell and is prepared in light of the current invention.

With reference now to the drawings, and in particular to FIG. 1 thereof, the preferred embodiment of the new and improved adjustable dumbbell system embodying the principles and concepts of the present invention and generally designated by the reference numeral 10 will be described.

From a broad standpoint, the present invention is a dumbbell can realize different weight choices on a single piece of rod. The dumbbell is characterized in that the dumbbell can regulate the capacities of different weights. In other words, the dumbbell can randomly regulate one pair of dumbbell handwheels to the mark of the scheduled weight when the dumbbell is positioned on a dumbbell tray. A double safety locks system is provided and realizes the following two effects: when the dumbbell is positioned on the dumbbell tray, the dumbbell handwheels can realize choosing of gears of different weights by undergoing rotation of 360 degrees to the most. When, however, the dumbbell is positioned between two gears, the safety locks of the dumbbell tray work, which makes the attempt to lift the dumb bar fail and the lifting of dumbbell available only when the safety locks are released by correctly positioning the gears. When the dumbbell bar is lifted, the safety locks on the dumbbell bar work and the dumbbell handwheels at this time fail to rotate, thus ensuring the safety in use. The invention has the advantage that the dumbbell weight can be regulated quite conveniently, thus ensuring convenient and safe use of a lighting bar and making the choosing of different weights on a single piece of bar available. Another advantage is that the invention is simple in both use and installation.

The present invention, the adjustable dumbbell system 10 is comprised of a plurality of components. Such components in their broadest context include a dumbbell, a tray and a safety lock. Such components are individually configured and correlated with respect to each other so as to attain the desired objective.

First provided is a dumbbell 10. The dumbbell has a handle 3. The handle is in a cylindrical configuration. The handle has opposed ends. The handle has a central extent. The dumbbell has a tubular grip 18. The grip has opposed ends. The opposed ends rotationally receive the central extent of the handle. The dumbbell has an adjustment wheel 14. The adjustment wheel is secured to each end of the handle. In this manner the handle may be rotated with respect to the grip. The dumbbell has a side cover 20. The side cover is secured to each end of the grip. The dumbbell has a dowel disk 22. The dowel disk is rotatably supported on the handle adjacent to each side cover. Each dowel disk has inwardly extending fingers 21. Spaces are provided between the fingers. The dumbbell has a plurality of cam bits 24. The cam bits are rotatably supported on the handle between the dowel disks and the adjustment wheels. The dowel disks and cam bits on each side of the grip are secured for concurrent rotation about the handle.

A plurality of weights 16 is provided. One weight is provided for each cam bit. Each weight has openings 5, 16, 27. Each cam bit has a cam surface. In this manner the weights are adapted to attach to and release from an associated cam bit as a function of the rotational orientation of the shaft and adjustment wheels. Each weight has a central primary aperture. Each weight has a primary slot. Each weight has a major section. Each weight has an axially offset secondary minor section. The minor section has a secondary aperture. The minor section has a secondary slot. Each cam plate has an irregularly shaped polygon. Each polygon has radially enlarged sections. In this manner the cam surfaces are provided at maximum radii greater than the radii of the remainder of the cam plate. The radially enlarged sections are adapted to releasably couple selectively with the secondary aperture of the weights.

Provided next is a tray 12. The tray is adapted to removably receive and support the weights. The tray has parallel spacers 30. In this manner the weights may be separated when supported by the tray. The tray has two upstanding components 29. Each upstanding component has an outwardly extending finger 31. Each upstanding component with its outwardly extending finger is located generally vertically aligned with an associated side cover when the dumbbell is positioned on the base.

Further provided is a safety lock 34. The safety lock is positioned within each side cover for vertical movement. The safety lock has a coil spring 7. The coil spring urges each safety lock downwardly. The safety lock is in a lower orientation between the spaces of the side cover when the dumbbell is removed from the base. In this manner only limited rotation is allowed between the dowel disks, cam bits, handle and adjustment disks with respect to the side covers and grip. The safety lock is urged by the fingers of the base to a raised orientation when the dumbbell is position on the base. In this manner the fingers of the base will be above and in contact with fingers of the dowel plate. Further in this manner lifting the dumbbell from the base and allowing full rotation between the dowel disks, cam bits, handle and adjustment disks with respect to the side covers and grip is precluded.

Provided last is a plurality of holes 15. The holes are provided in each dowel disk. A plurality of associated ball bearings 19 is provided. The ball bearings are supported within each side cover. The coil springs urge the ball bearings into the holes when weights have been properly selected. In this manner the adjustment wheels are rotated. The ball bearings will move from the holes until weights have been properly selected. In this manner the ball bearings will enter associated holes along with an audible click to indicate that it is safe to lift the dumbbell from the base.

More specifically, the present invention refers to an adjustable dumbbell system which is characterized in that a user can adjust the lifting weight by rotating the dumbbell handwheels. Protection can be realized on the dumbbell tray, which allows a user to lift the dumbbell only when adjusting the handwheels to a proper position. The safety device is equipped on the dumbbell bar and works when the dumbbell is lifted so that the handwheels fail to rotate, thereby ensuring the safety in use.

As a body-building instrument, the dumbbell is extensively applied for trainings such as chest expansion training, biceps brachii and deltoid. The wide application of the dumbbell puts forward a demand of the users for dumbbell sheets of different weights, however, weight changing can be realized merely through frequent dismounting and replacing the dumbbell sheets, which results in some trouble to the users due to the frequent and complicated procedures.

In order to cope with the problem, the present invention realizes the lifting weight of the dumbbell conveniently without the complicated procedure of dismounting and replacing the dumbbell sheets. The dumbbell of the present design greatly differs from the conventional dumbbells in terms of structure.

Our solution to the problem is the present invention dumbbell which realizes very quick and convenient adjustment of the dumbbell weight, convenient use, and makes the use of the lifting bar safe and the choosing of different weights on a single piece of bar available.

The dumbbell bar is structurally characterized in that the middle is a hand-held grip which is equipped with nylon side covers at two ends and each nylon side cover is connected with a nylon bridge-shaped block, therefore, being integrated with the grip as a whole. The outer end of each nylon side cover is installed with a metallic dowel disc, a cam spacing ring, a metallic cam and a plastic dumbbell handwheel.

The metallic dowel discs, cam spacing rings and cams at the two ends are connected with the dumbbell handwheels via the mandrel of the grip. Therefore, the handwheels can realize rotation of 360 degrees to the most when no locking status is available.

One circle of chamfering edge holes are arranged on the plane of each metallic dowel disc to correspond to the ball bearings on the side covers, thus providing a plurality of accurate gears when the dowel discs rotate.

The end faces of the metallic dowel discs have one circle of open slots which make the safety locks at the interiors of the side covers go through the open slots under the action of the spring to realize locking, when the dumbbell bar goes away from the dumbbell tray and reaches the correct gear.

The method to release the dumbbell bar involves the steps of positioning the dumbbell on the dumbbell tray. A lug boss on the tray ejects the safety locks out to release the locking. At this time, the lifting weight of the dumbbell can be chosen freely.

The lug boss on the dumbbell tray is also provided with a metallic latch hook. In such case, when the dumbbell bar is at a correct gear, the latch hook can smoothly go through the open slots of the dowel discs; when the dumbbell is not on the correct gear, the latch hook will lock the end face hooks of the dowel discs, at this time, the dumbbell cannot be lifted from the dumbbell tray.

In addition, the dumbbell has two groups of special metallic dumbbell sheets respectively coming into being by riveting a plurality of steel plates; an open slot is made at the middle to enable the dumbbell capable to slide free at the open slot. The external side of each piece of steel plate is riveted with another steel plate with a larger hole and a smaller opening so that when a cam rotates to some angle in the hole, the cam is blocked by the smaller opening, thus enabling the dumbbell to lift the dumbbell sheet.

We can find from corresponding drawings and application that other characteristics and advantages of the dumbbell are quite notable.

The adjustable dumbbell system involved in the current invention may provide an adjustable dumbbell 10 and enable users quite easily to choose the dumbbell weight. A user may place the dumbbell on the dumbbell tray 12, rotate the dumbbell handwheels 14 to choose the dumbbell 16 for the needed weight and finally lift the adjustable dumbbell from the dumbbell tray to undergo exercise. The adjustable dumbbell shall bear such chosen weight and the unnecessary weight will be placed on the dumbbell tray. In case of an intent of changing the weight, the user only needs to put the dumbbell back onto the dumbbell tray and to rotate the dumbbell handwheels to choose the proper weight. When the adjustable dumbbell has left the dumbbell tray in the exercise course, the dumbbell has had its weight fixed, at this time, the intent to rotate the dumbbell handwheels to increase or decrease the weight will fail.

Figure 2:
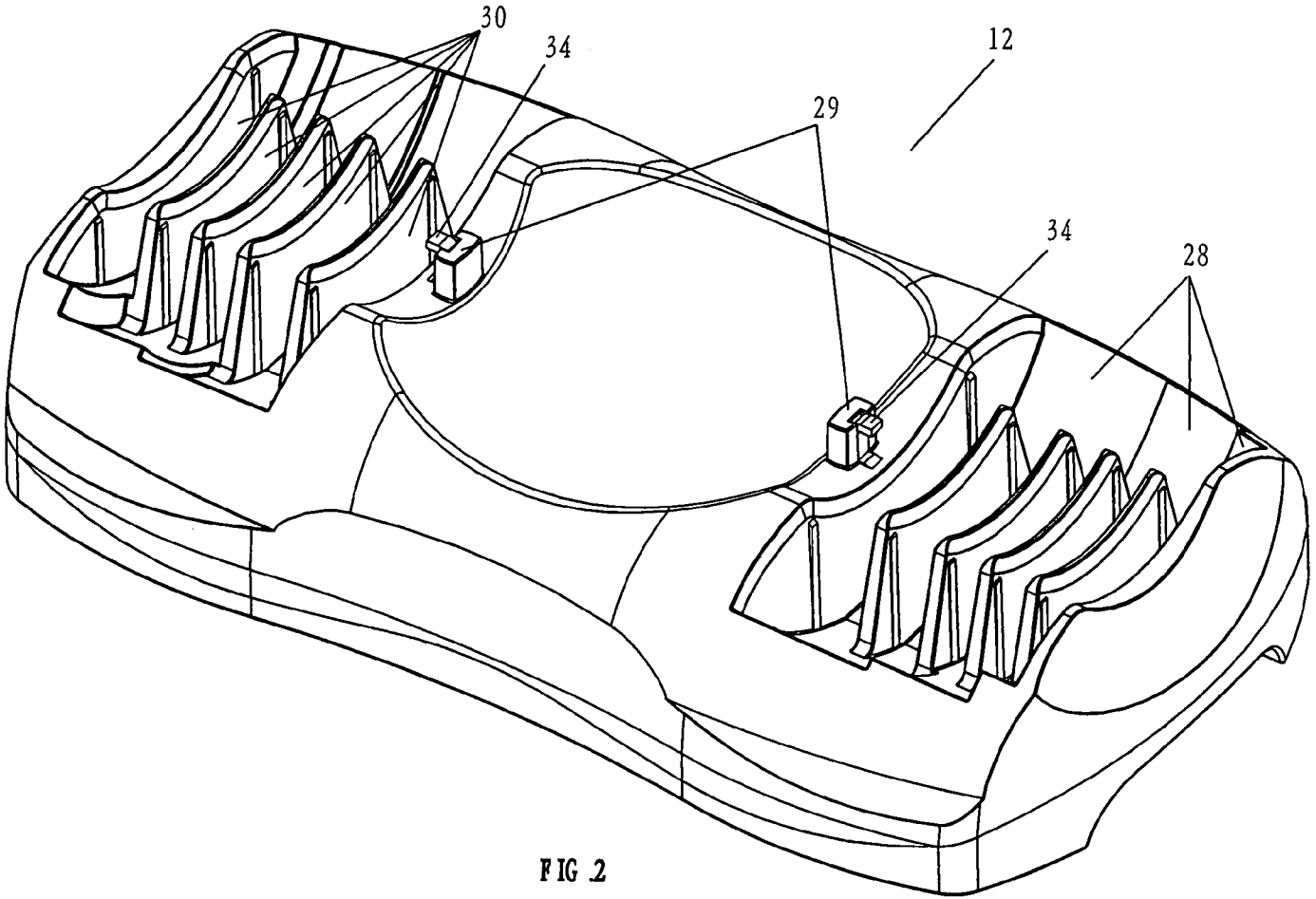
FIG. 2 is a drawing of the equal size of the dumbbell tray and is prepared in light of the current invention.
Figure 7:
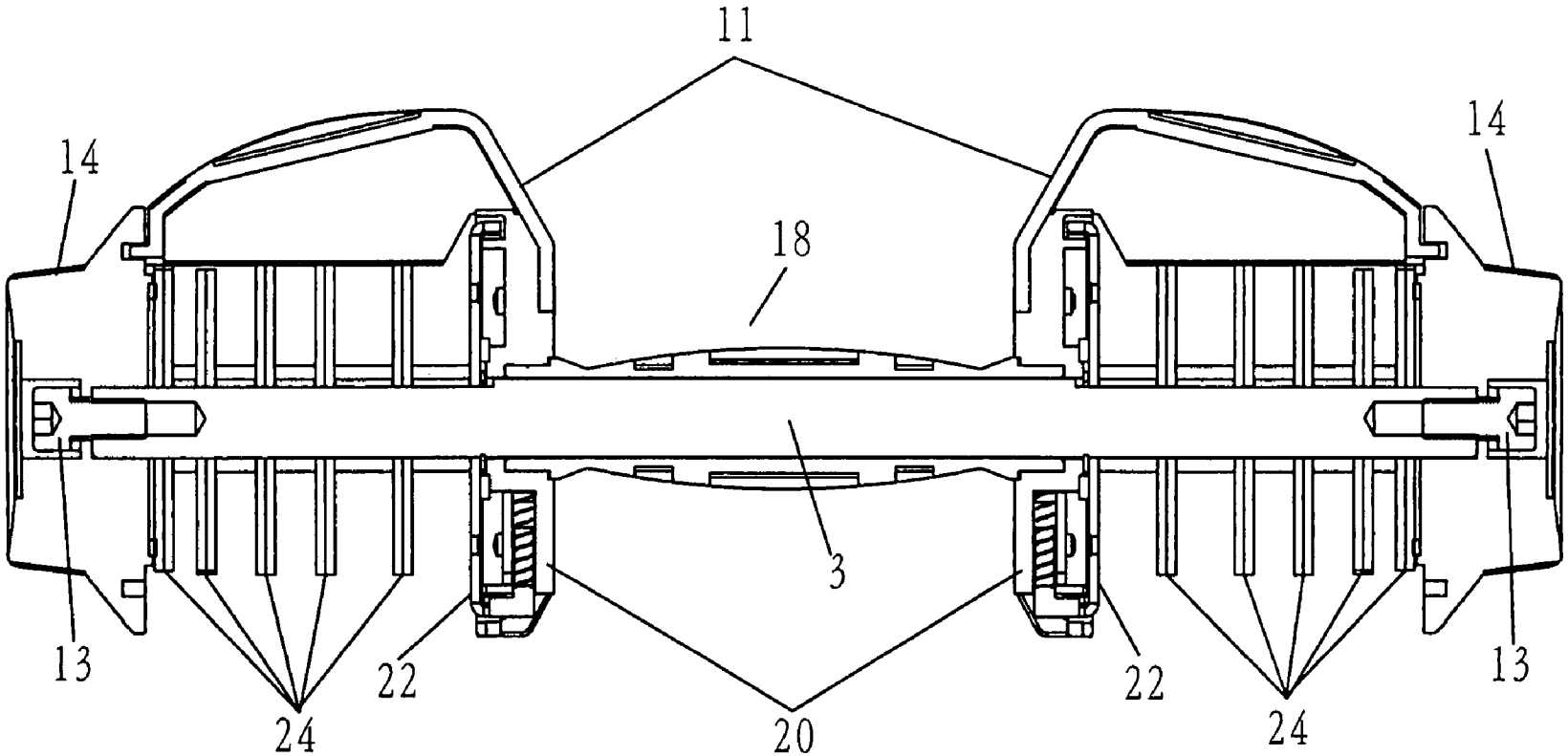
Figure 34:
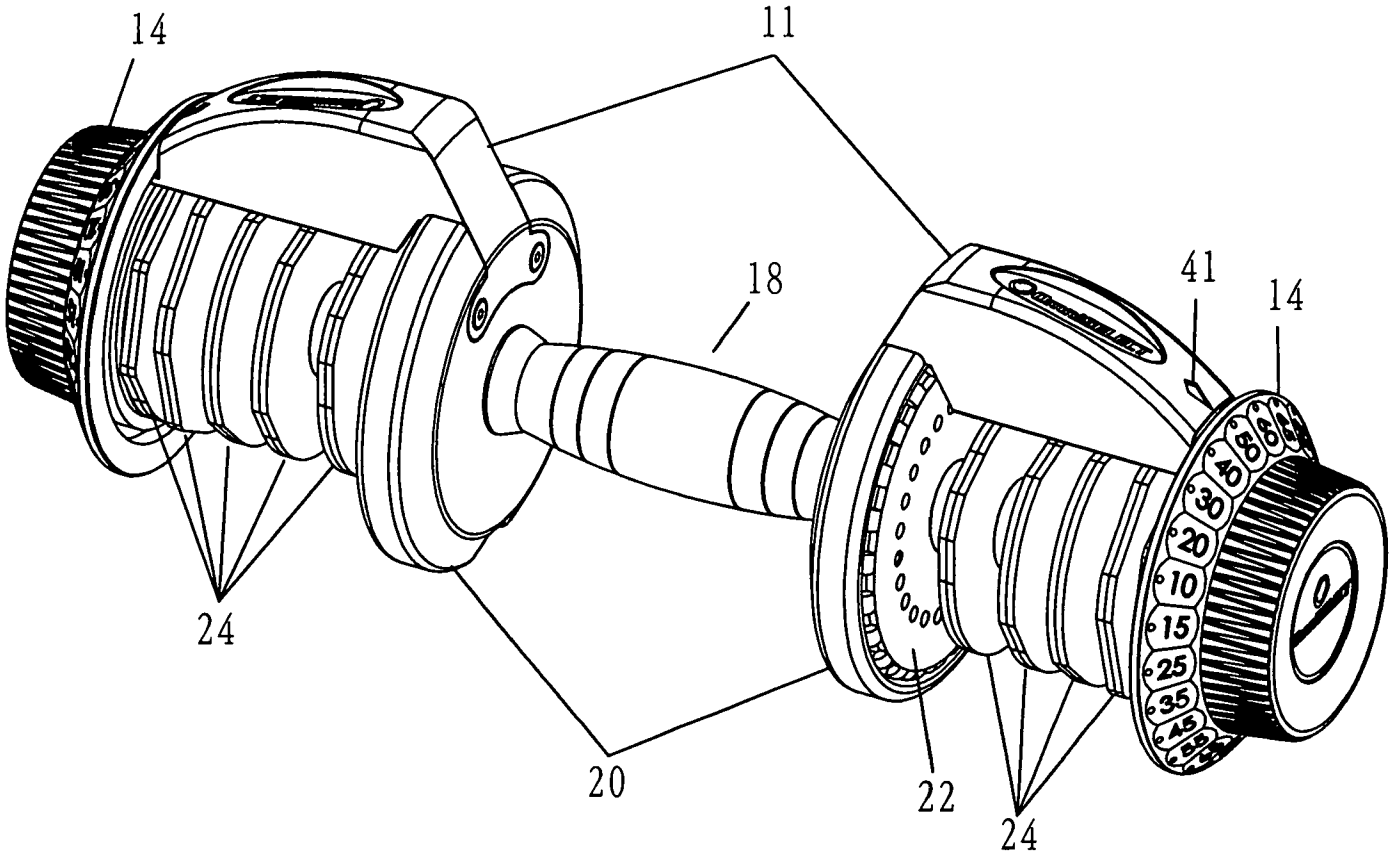
FIG. 34 is a 3D view of the dumbbell bar.

The adjustable dumbbell system comprises an adjustable dumbbell 10 shown in FIG. 1 and a dumbbell tray 12 shown in FIG. 2. Wherein, the adjustable dumbbell 10 contains a grip 18, one pair of side covers, bridge-shaped blocks 11 and dowel discs 22 respectively, some dumbbell sheets 16, some cam bits 24 and one pair of dumbbell handwheels 14 as shown in FIG. 7 and FIG. 34.

As shown in FIG. 2, the dumbbell tray 12 is used for placing the adjustable dumbbell 10. It, when not in use, allows the dumbbell's weight adjustment and may be used for placing the dumbbell sheets which are not lifted by the dumbbell bar. Before using the dumbbell 10, a user should first made decision on the weight for lifting. When the dumbbell is placed on the dumbbell tray, the weight gears on the dumbbell handwheels may be rotated to set the dumbbell sheets at the grip 18. There is a groove plane 28, a dumbbell sheet isolating metope functioning as a spacer 30, a lug boss plane 29 and one pair of locking hooks 31 on the dumbbell tray. The dumbbell sheets are placed on the groove plane so that the groove plane is prone to be positioned at the center. The isolating spacer can ensure the vertical placement of the dumbbell sheets, thus making the adjustable dumbbell quite easy to be placed on and lifted from the dumbbell tray. When the dumbbell is placed on the dumbbell tray, the lug boss plane and the locking hooks will eject the safety locks in the side covers out from the open slots of the dowel discs, thus enabling the dowel discs to realize rotation of 360 degrees to the most. See FIG. 17.

Figure 3:
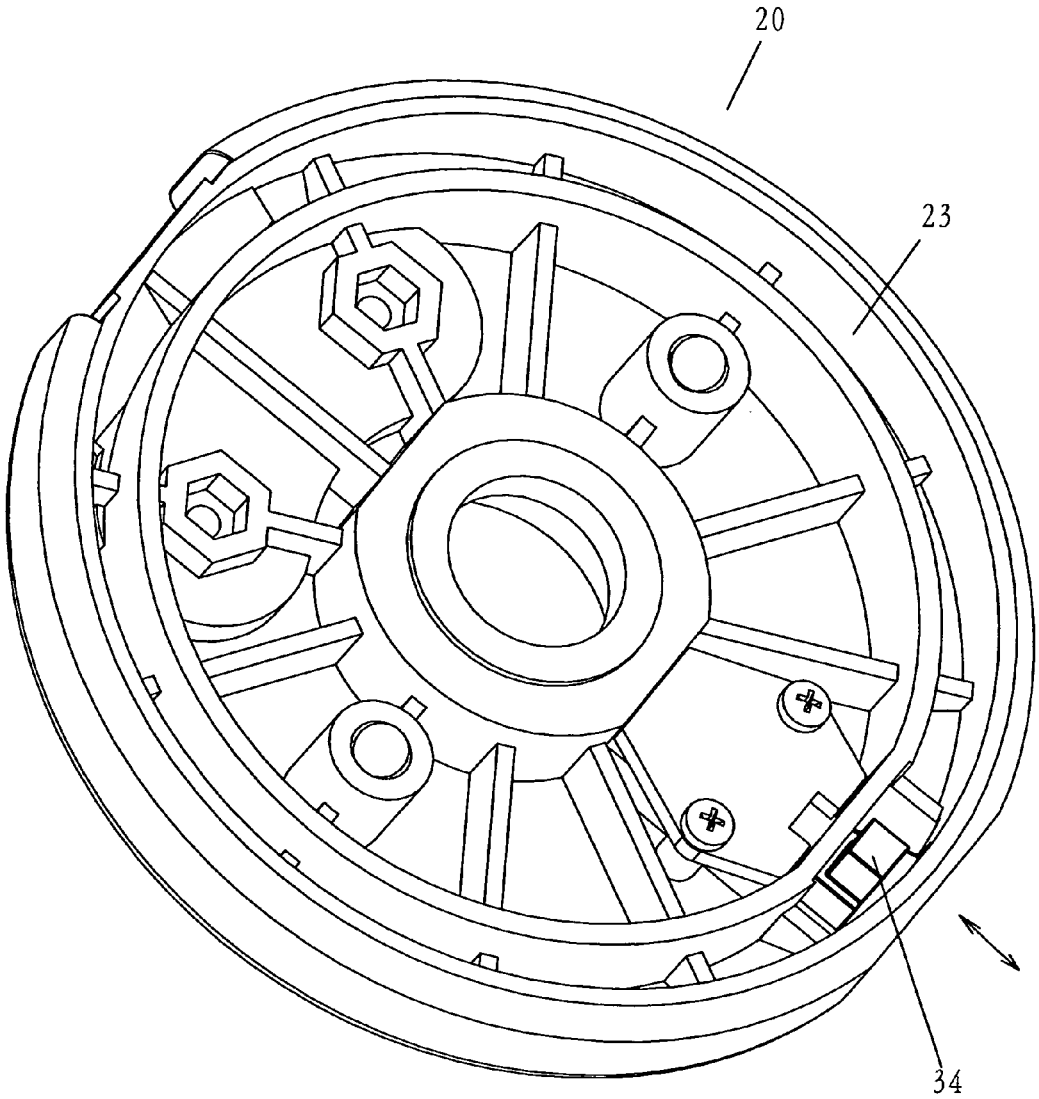
FIG. 3 is a drawing of the equal size of the side covers and mounting assemblies and is prepared in light of the current invention.
Figure 4:
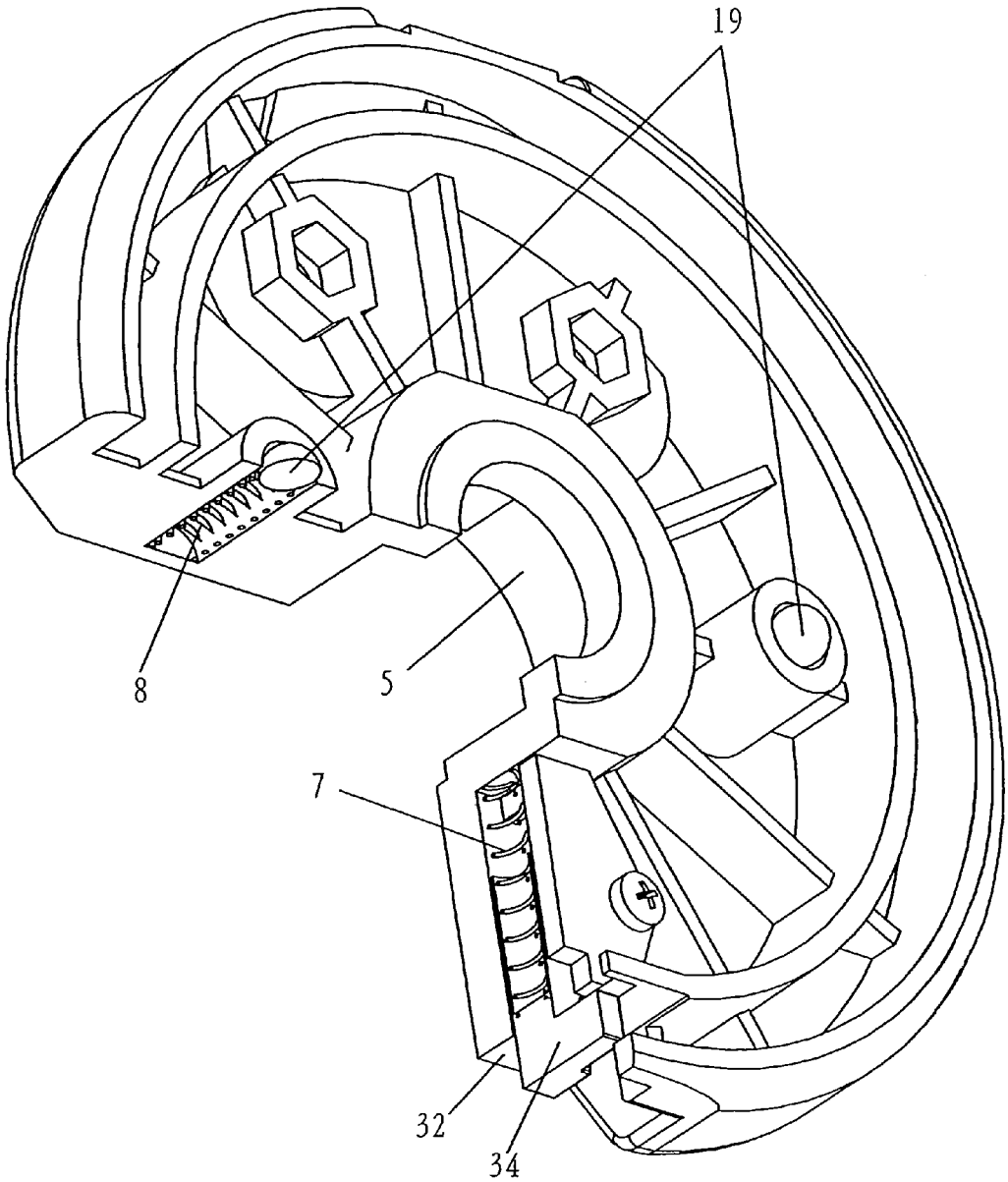
FIG. 4 is the inner constructional drawing of FIG. 3.
Figure 5:
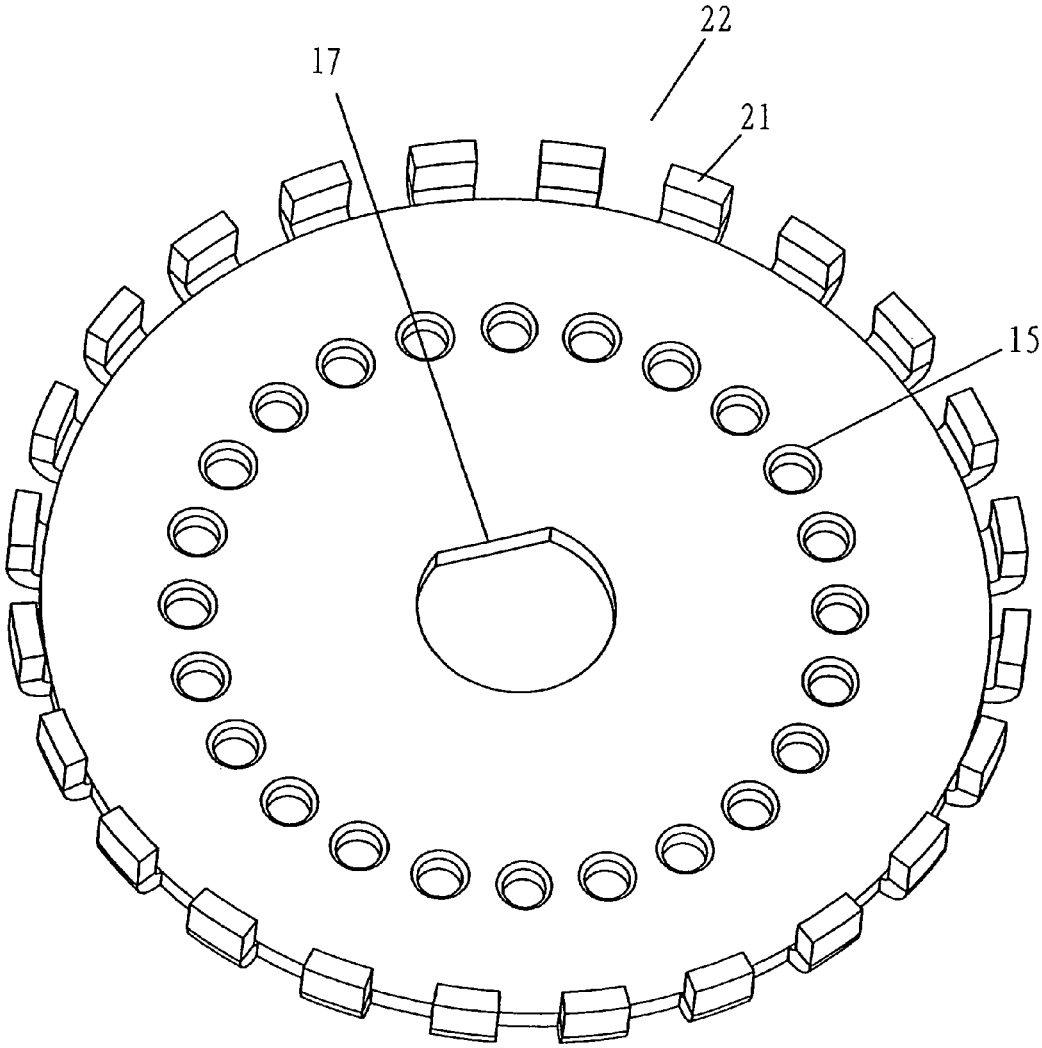
FIG. 5 is a drawing of the equal size of the dowel discs and is prepared in light of the current invention.
Figure 21:
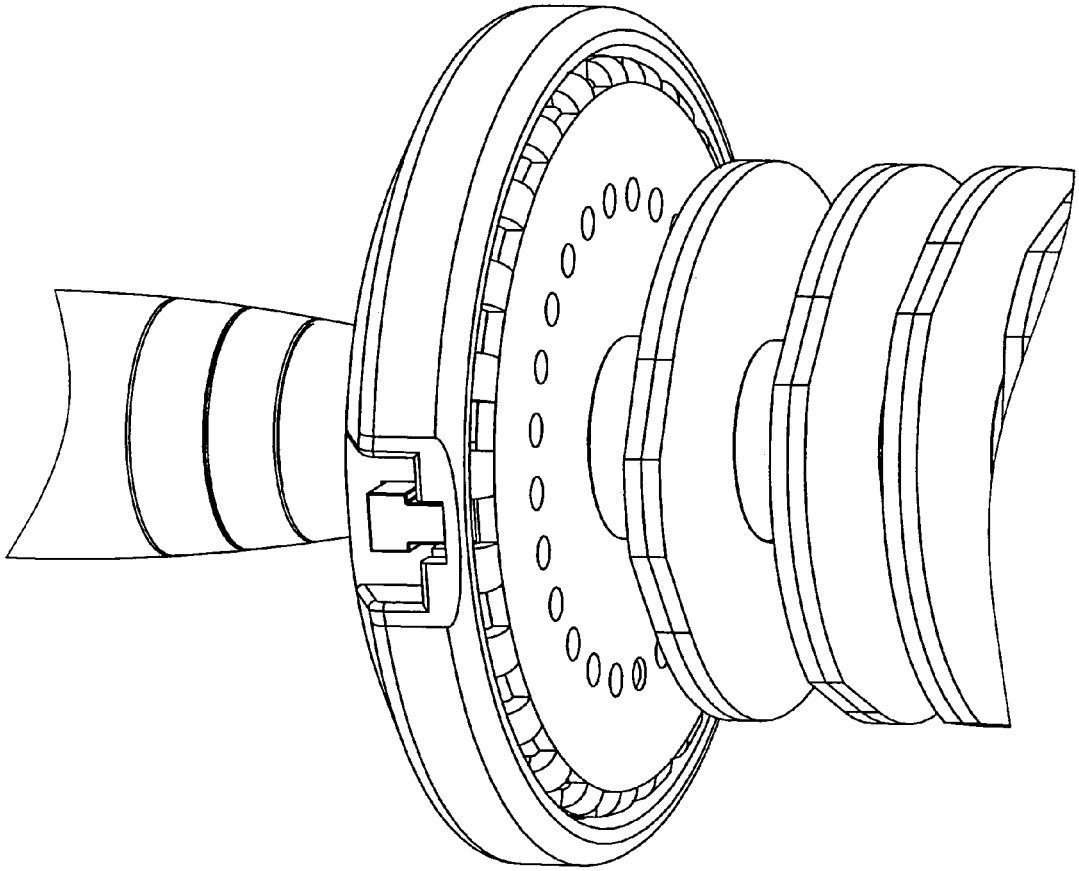
FIG. 21 is a partial view of the dumbbell bar in case of a safe locking.
Figure 22:
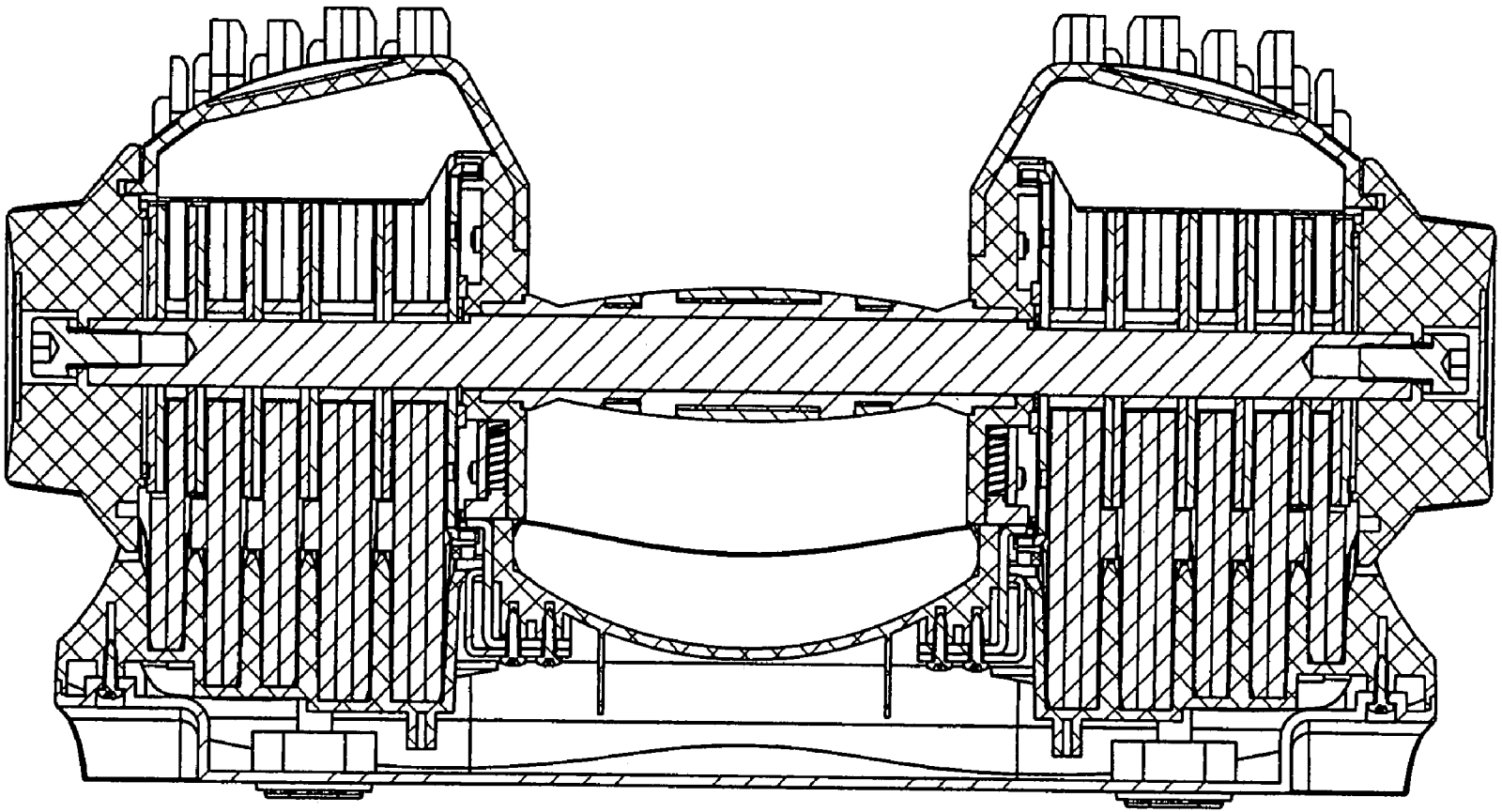
FIG. 22 is a front cutaway view of the adjustable dumbbell and the dumbbell tray and is prepared in light of the current invention.
Figure 23:
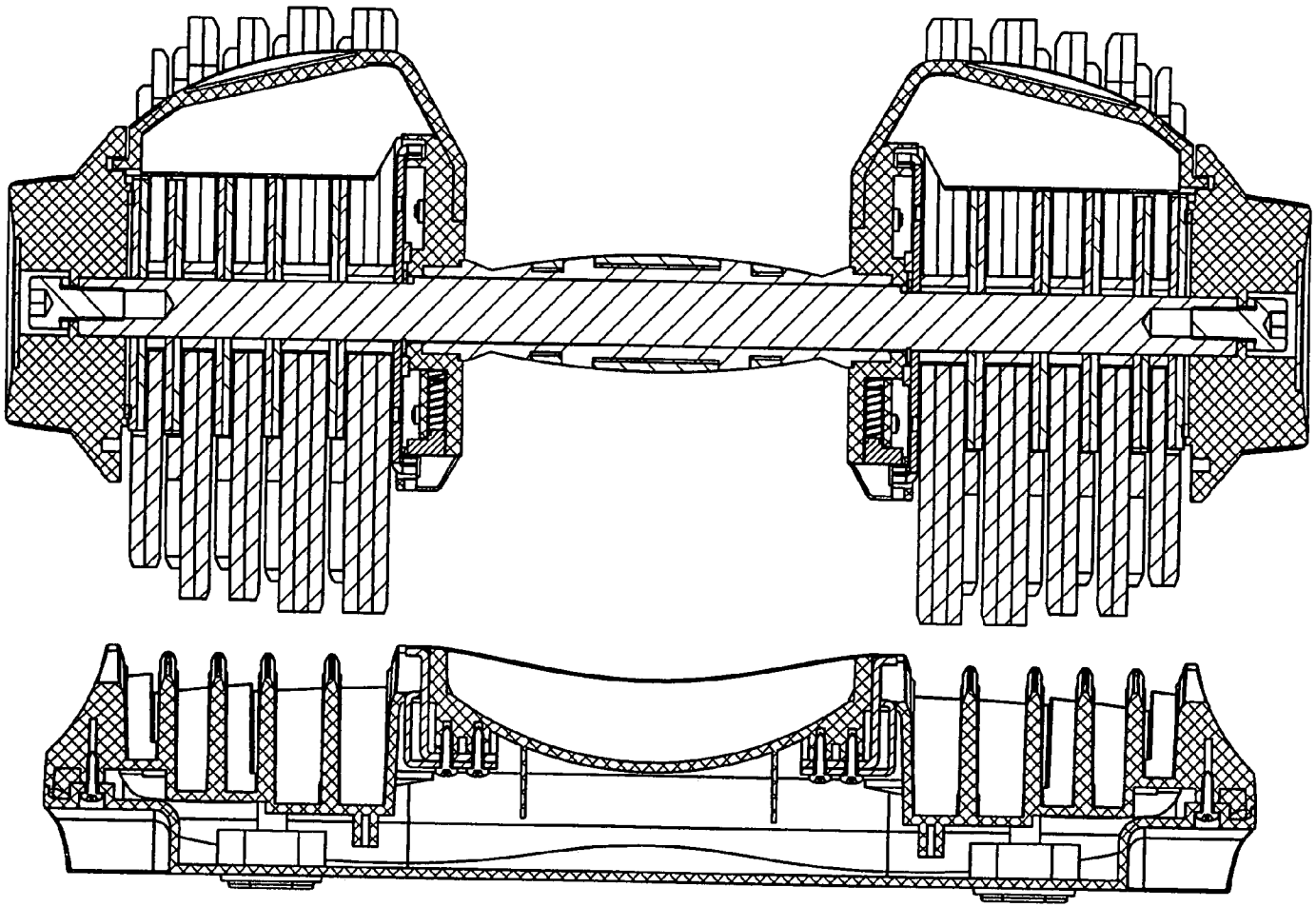
FIG. 23 is a front cutaway view showing the lifting course of the adjustable dumbbell from the dumbbell tray.
Figure 24:
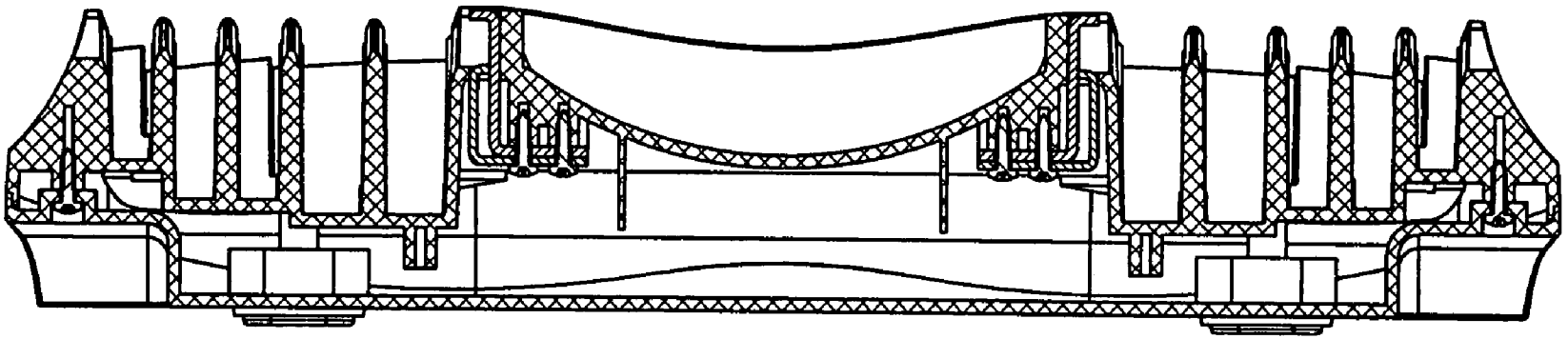
FIG. 24 is a front cutaway view of the dumbbell tray and is prepared in light of the current invention.

As shown in FIG. 3 and FIG. 4, the interior of each side cover is provided with a safety lock 34. See FIG. 19 which is a locking device. In such case, when the dumbbell bar leaves the dumbbell tray, the safety locks will, under the pushing of an internal spring 7, slide out and insert into the open slots 11 of the dowel discs 22, through which to make the dowel discs, the cam and the dumbbell handwheels all under a locking status. See FIG. 16 and FIG. 21).

As shown in Figures, the dowel discs 22 are installed closely to the side covers, with their hook possessing sides 21 inserting into the circular grooves 23 of the side covers. A round hole 15 corresponds with the ball bearings 19 and the ball bearings lean closely to the round holes under the pushing action of the spring 8. In such case, the dowel discs may be rotated to control accurately control the several groups of gears.

Figure 6:
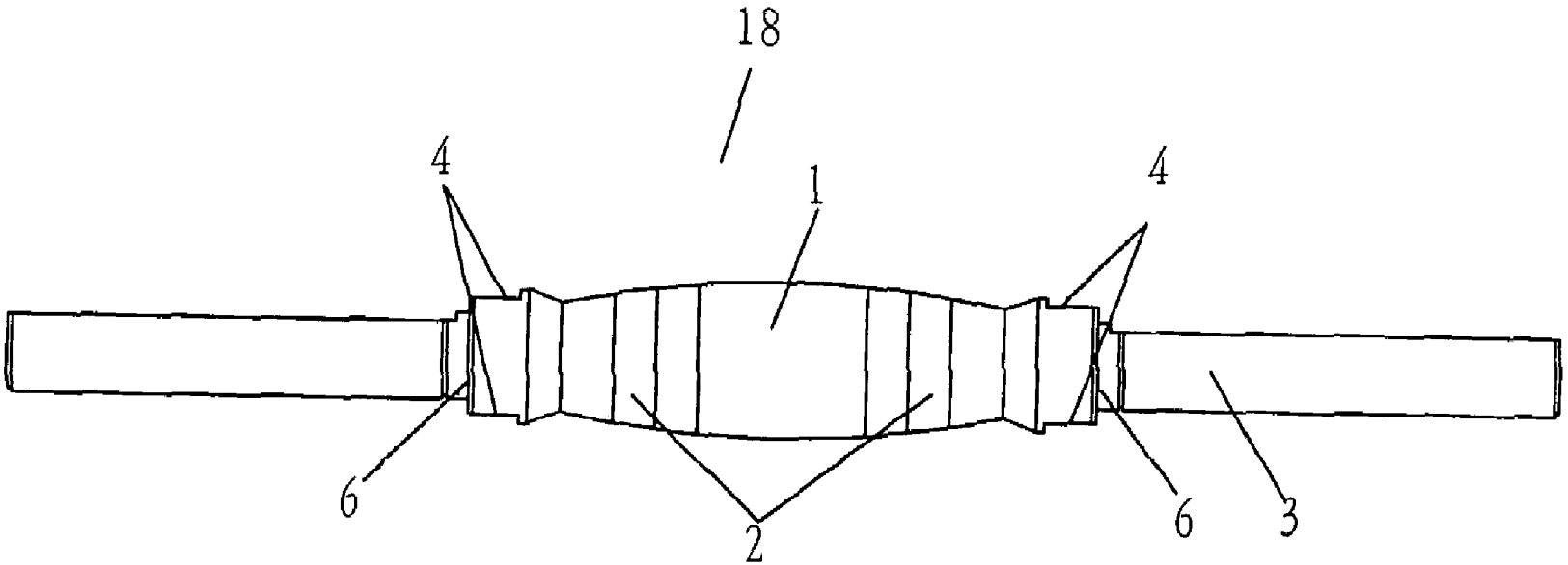
FIG. 6 is a front view of the grip and mandrel and is prepared in light of the current invention.
Figure 18:
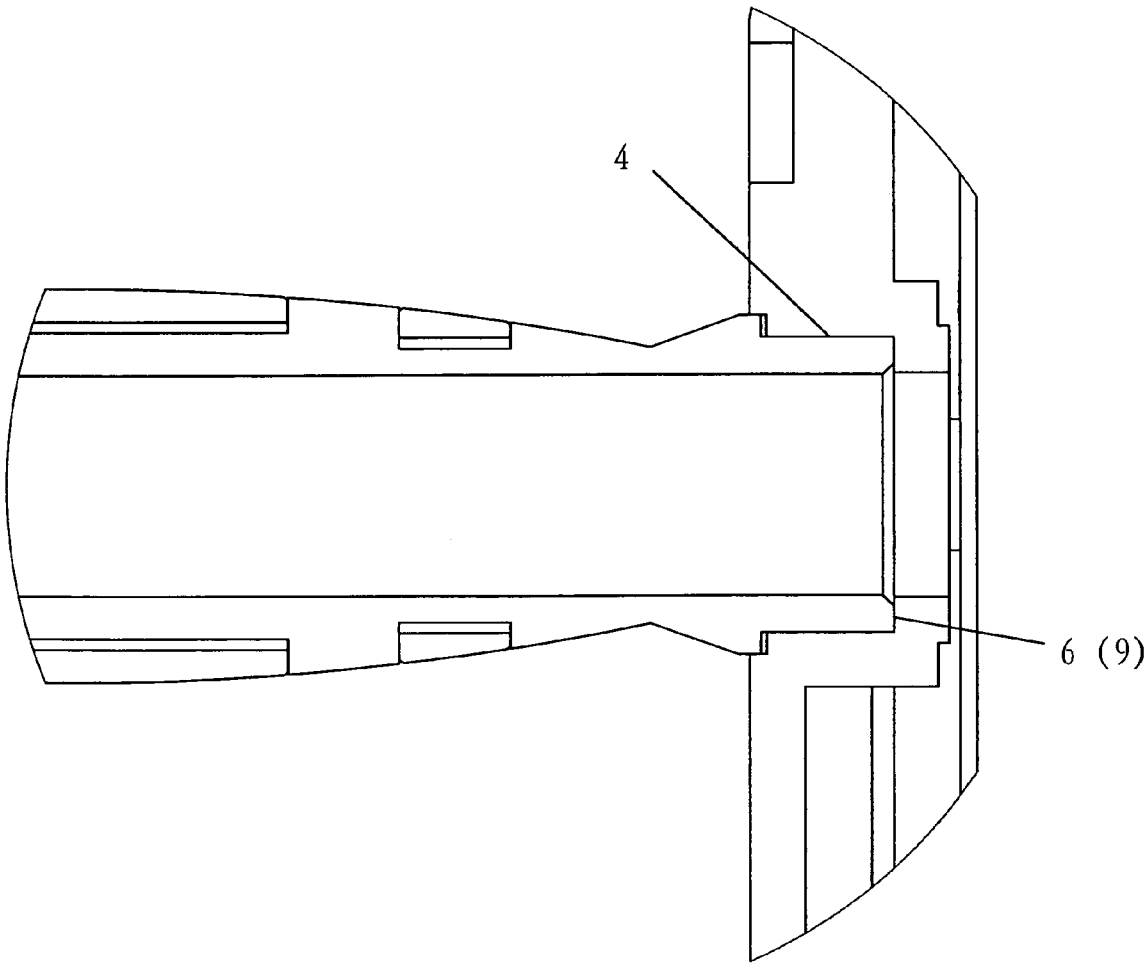
FIG. 18 is a cutaway view of the connected grip and side covers and is prepared in light of the current invention.
Figure 20:
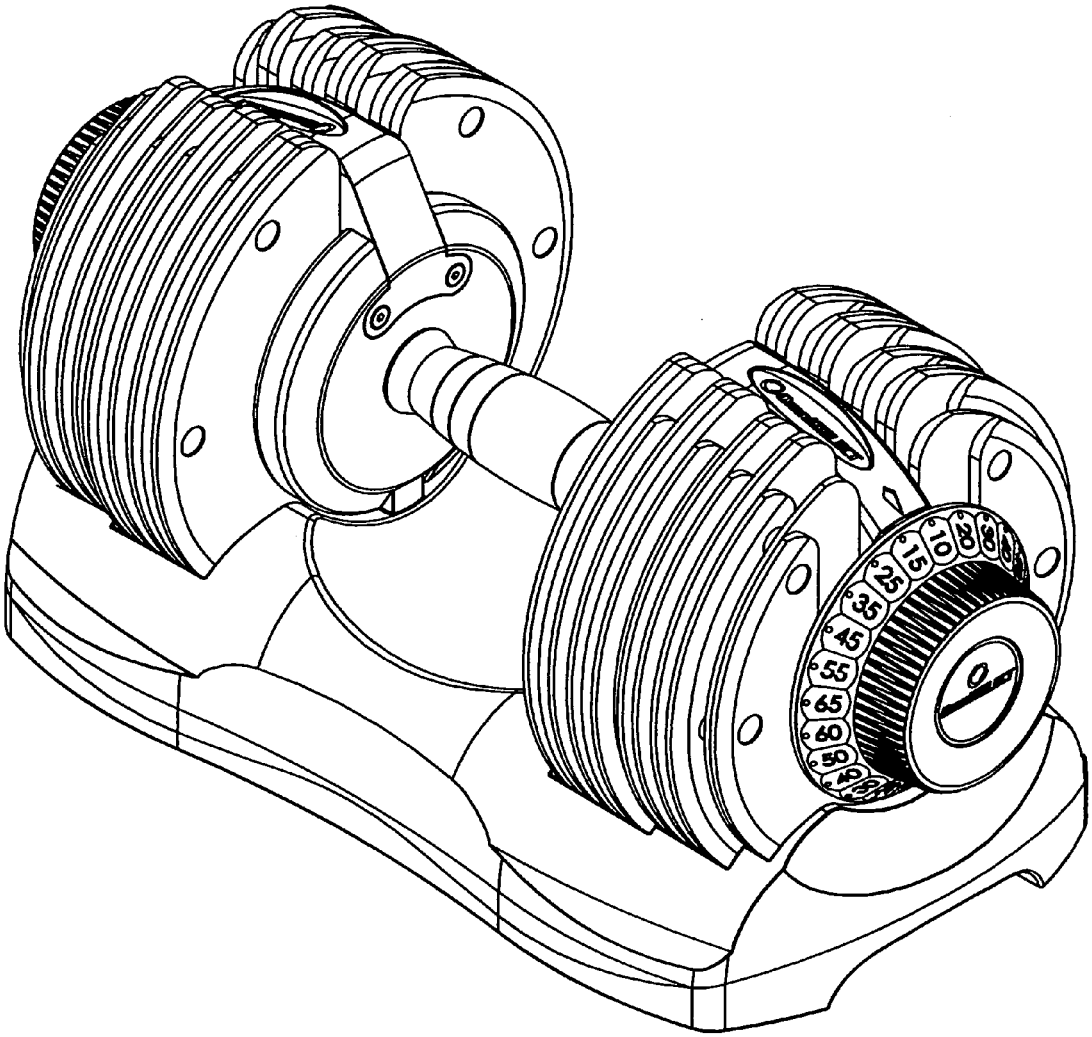
FIG. 20 is a 3D view of the adjustable dumbbell while it is placed on the dumbbell tray.
Figure 29:
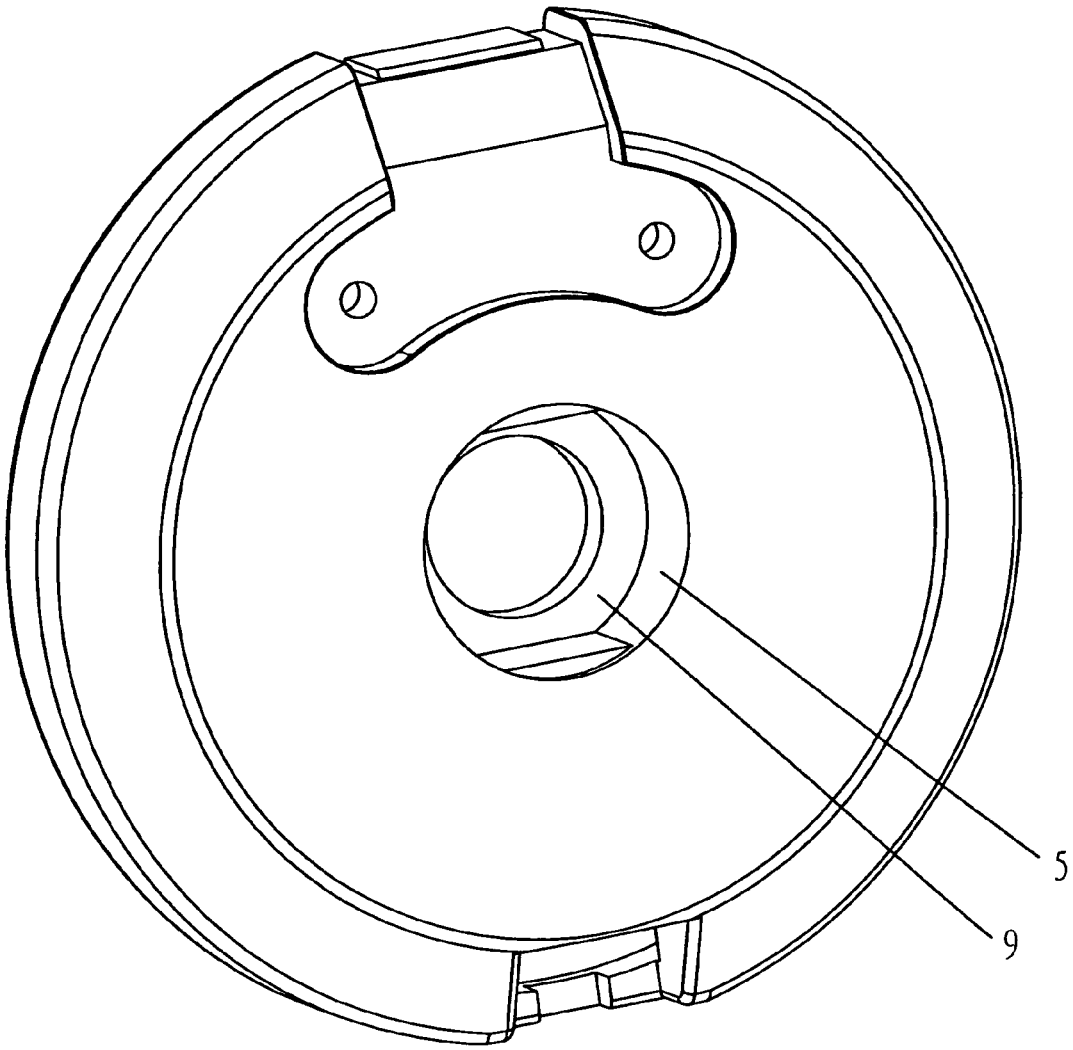
FIG. 29 is an exploded view the outer side of the side covers.
Figure 30:
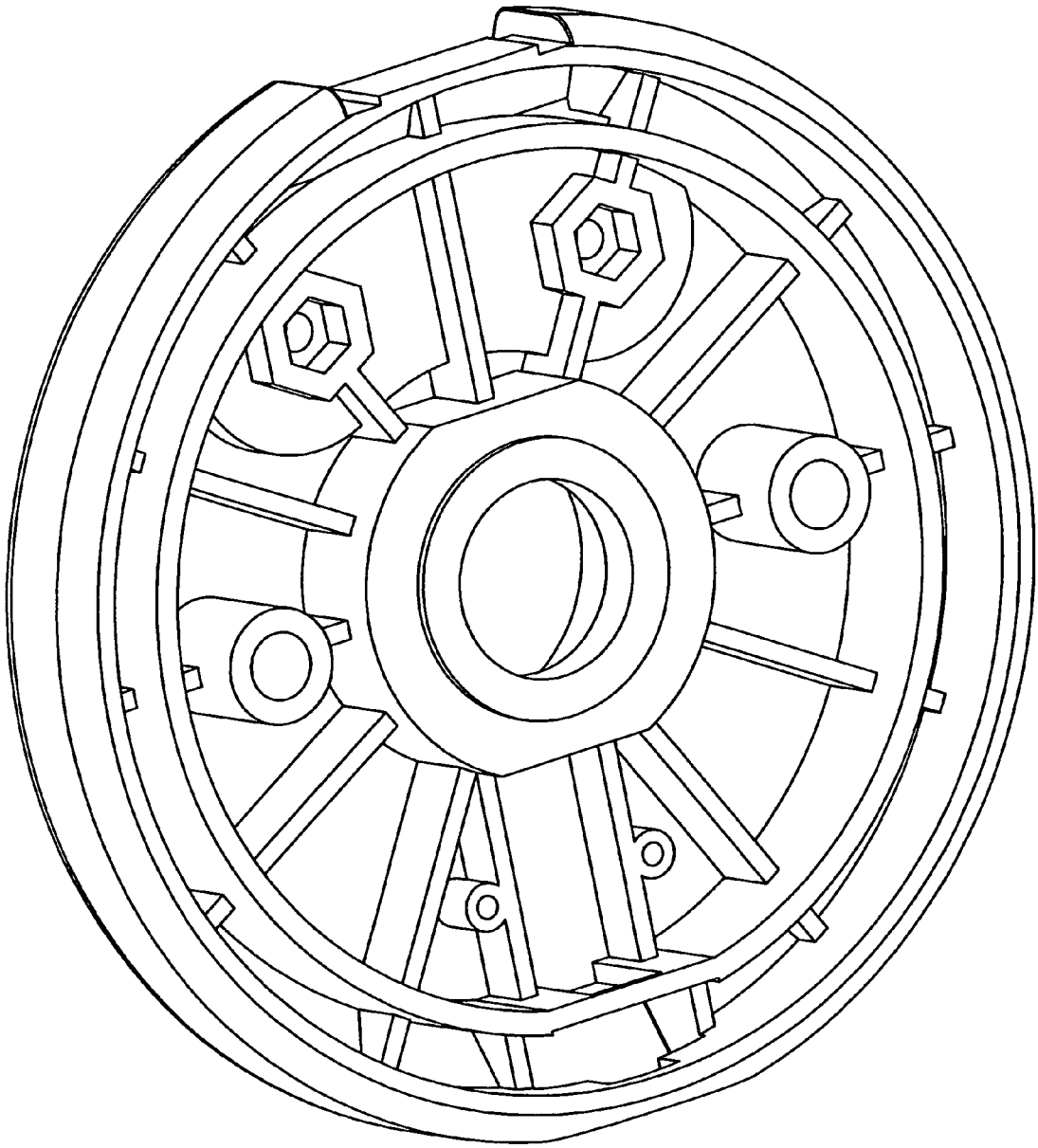
FIG. 30 is an exploded view the inner side of the side covers.
Figure 31:
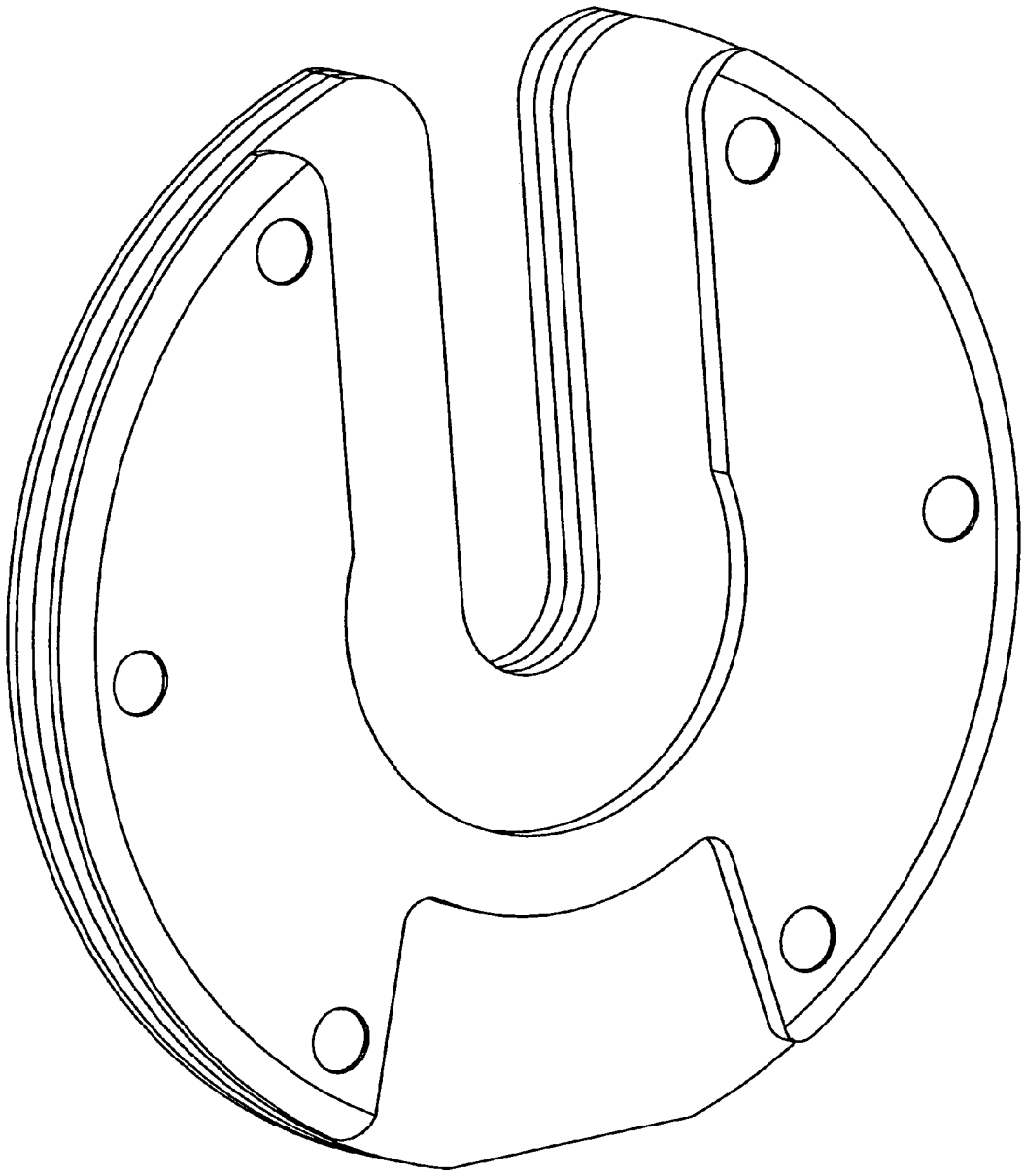
FIG. 31 is a 3D view of the dumbbell sheets.
Figure 32:
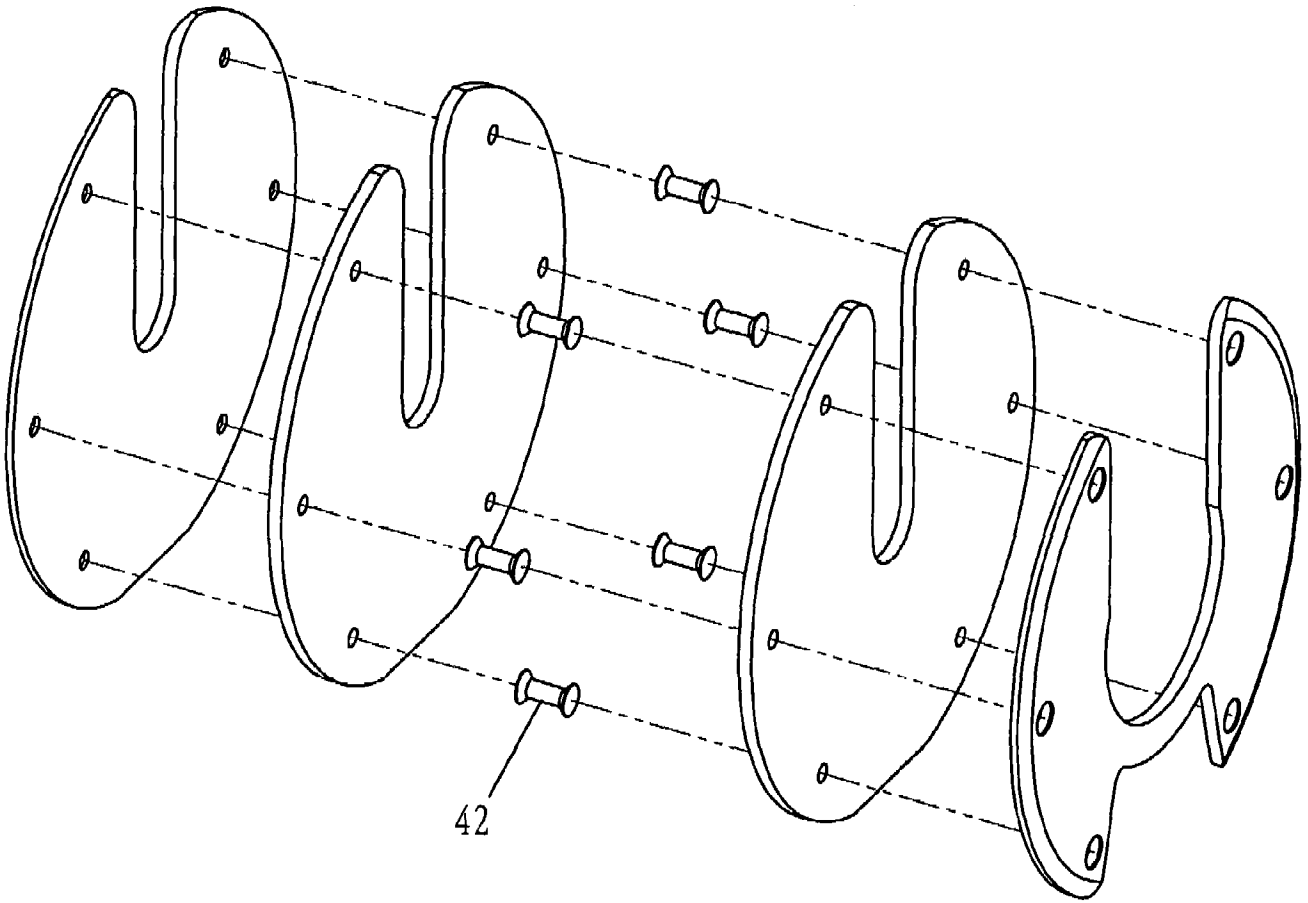
FIG. 32 is an exploded drawing of the riveting status of the dumbbell sheets.
Figure 33:
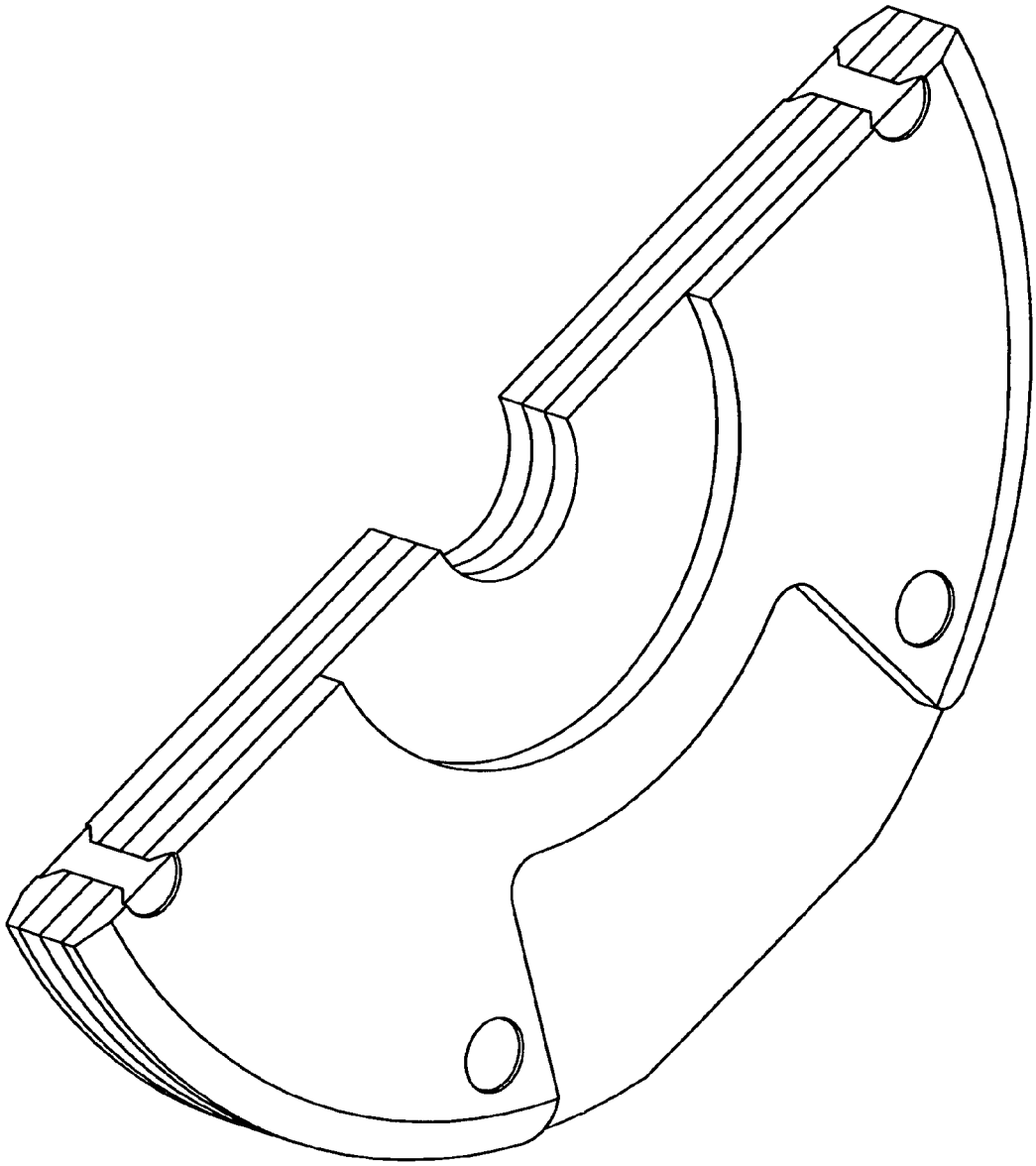
FIG. 33 is a cutaway view of the dumbbell sheets at the riveting.

As shown in FIG. 6, the grip of the adjustable dumbbell contains a drum-built metal body and a drum-built rubber coating 1, and rubber coatings 2 which are positioned at two sides. The holding part of the drum-built metal body looks like a doubling thread drop which has a larger diameter at middle and gradually declined diameters while going towards the two sides and has three pieces of circular grooves installed with the drum-built rubber coating 1, and rubber coatings 2 which are positioned at two sides respectively in a bid to avoid skid when in use. Two ends of the drum-built metal body have two oblate ends 4 which correspond to the oblate holes 5 of the side covers. See FIG. 18. The oblate shape can not only realize centralizing but prevent the side covers from rotating on the grip. The end faces 6 stand up to the end faces 9 of the side covers' holes 9. See FIG. 29, so as to inward slide. The drum-built metal body is hollow has a handle 3 goes through its hollow interior.

FIG. 7 is a complete installation drawing of the dumbbell bar. The bolts 13 connect the grip 18, the side cover 20 and the cam bits 24 with the dumbbell handwheels in an entire one via the handle 3.

Figure 8:
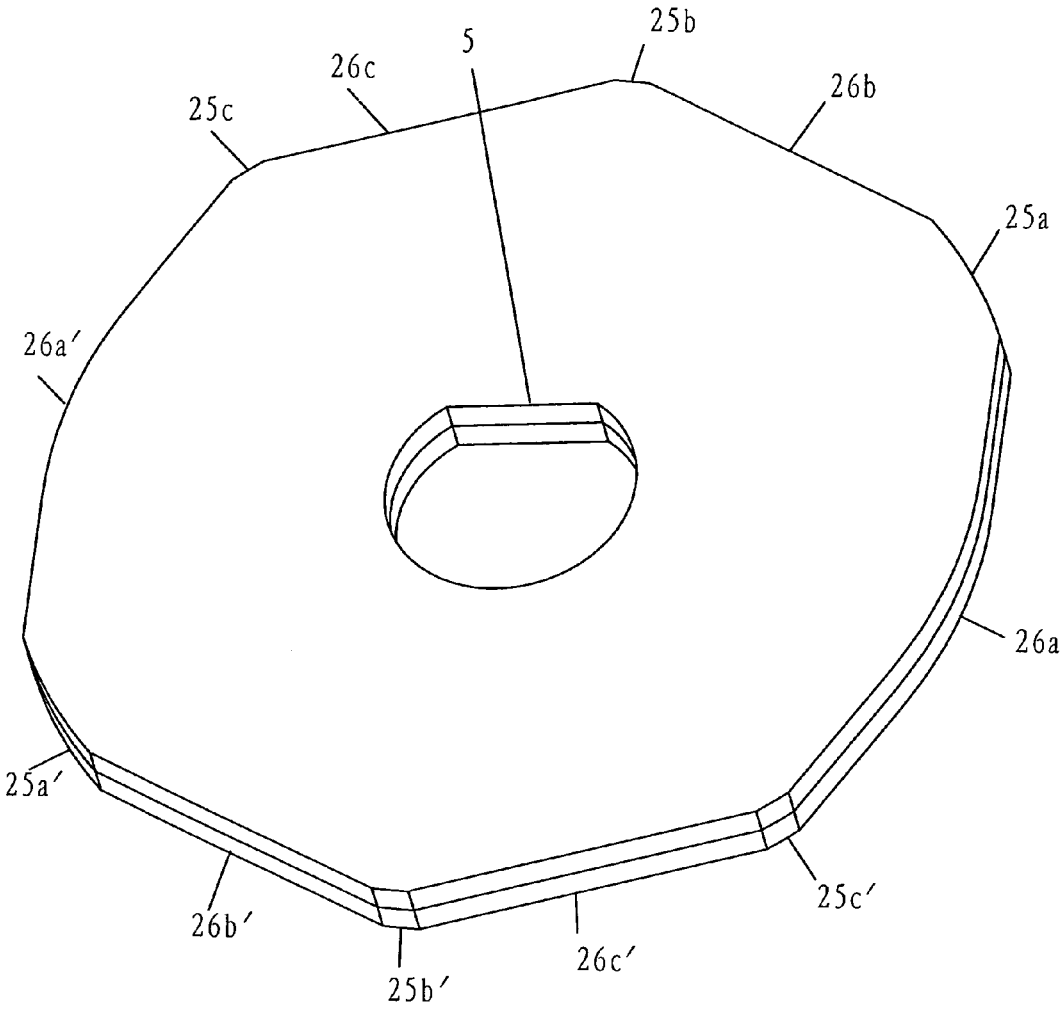
FIG. 8 is a drawing of equal size of the cam and is prepared in light of the current invention.
Figure 9:
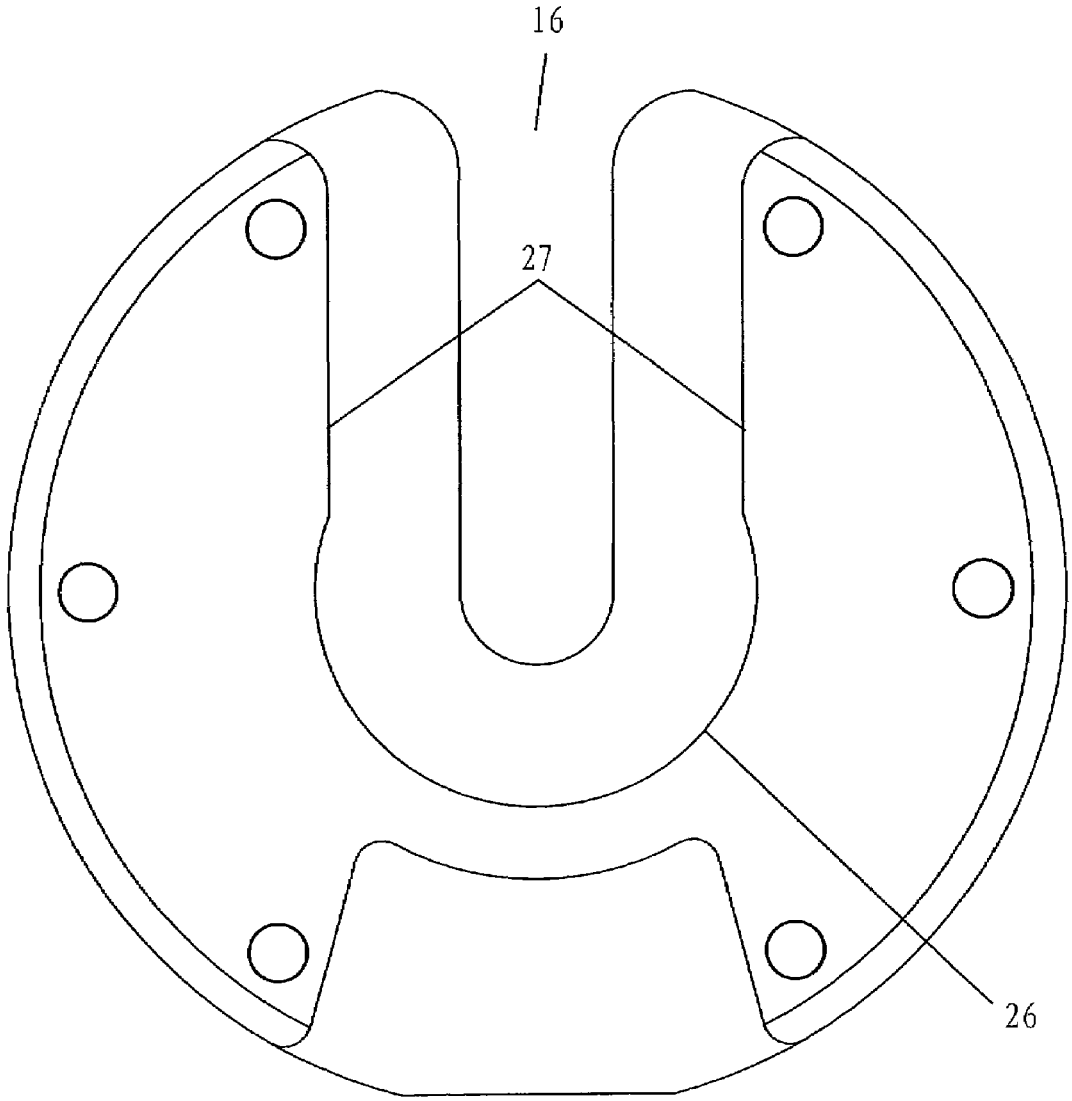
FIG. 9 is a front view of the equal size of the dumbbell sheets and is prepared in light of the current invention.
Figure 10:
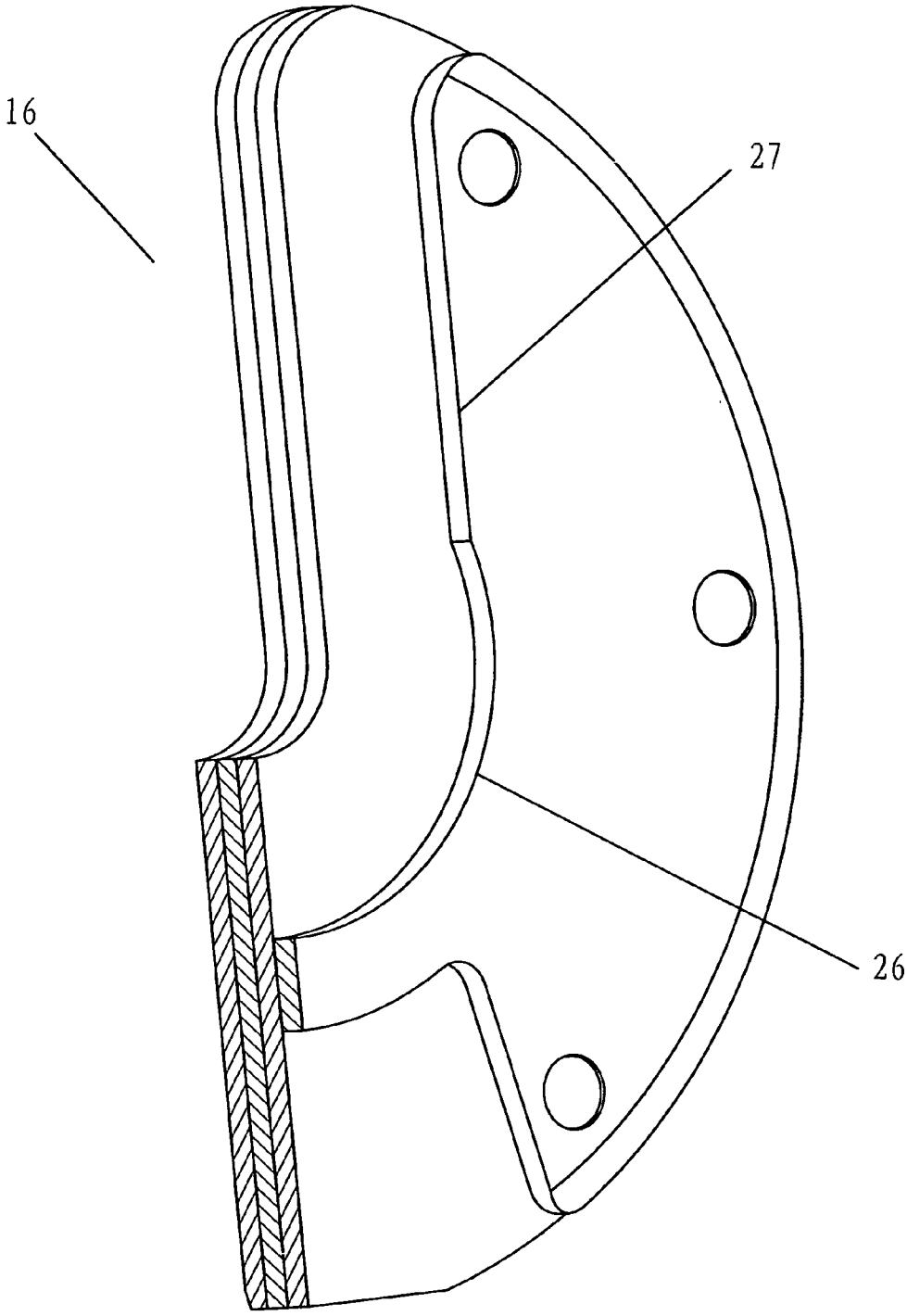
FIG. 10 is a drawing about the dumbbell sheets after cutting away FIG. 9.
Figure 11:
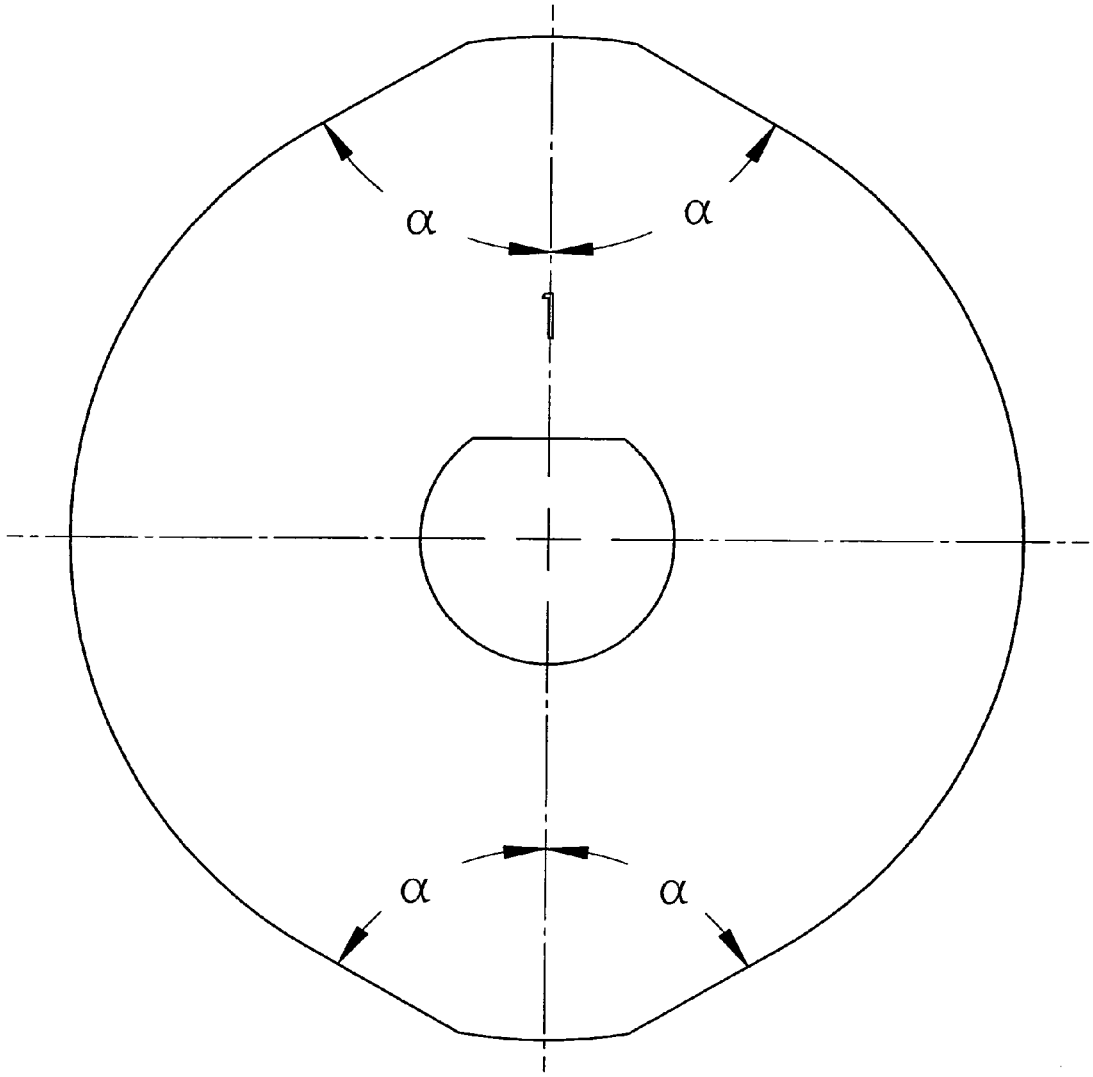
FIG. 11 is a drawing of the equal size of cam 1 and is prepared in light of the current invention.
Figure 12:
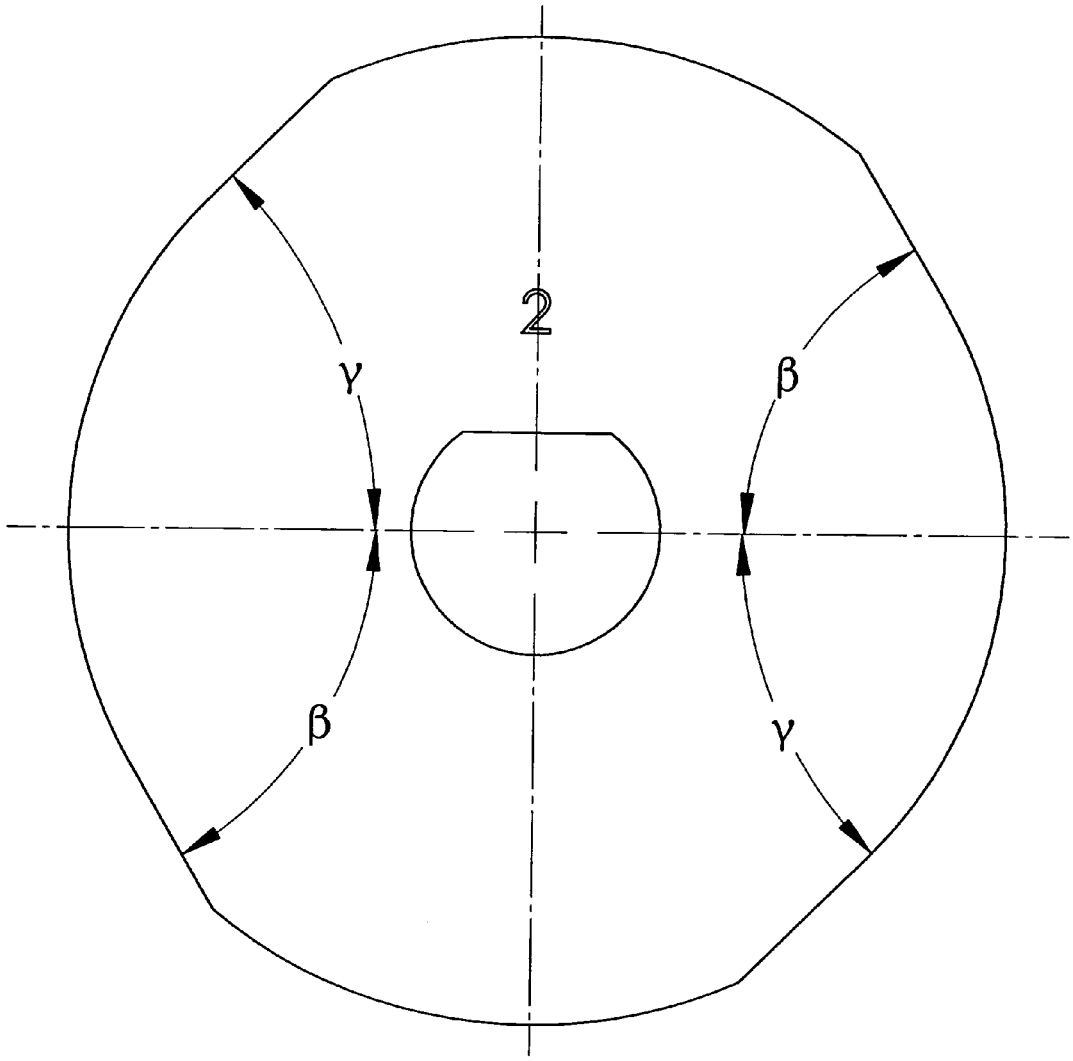
FIG. 12 is a drawing of the equal size of cam 2 and is prepared in light of the current invention.
Figure 13:
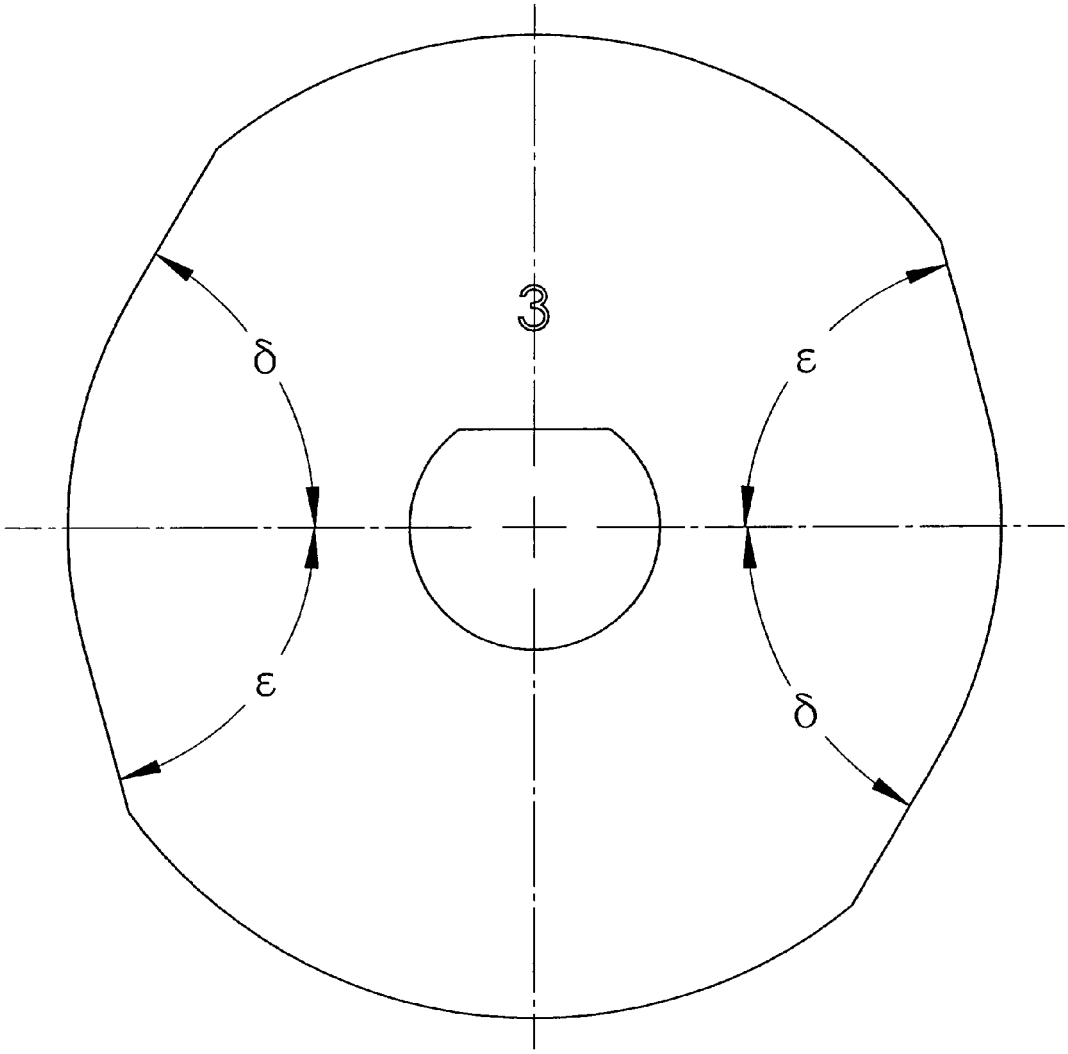
FIG. 13 is a drawing of the equal size of cam 3 and is prepared in light of the current invention.
Figure 14:
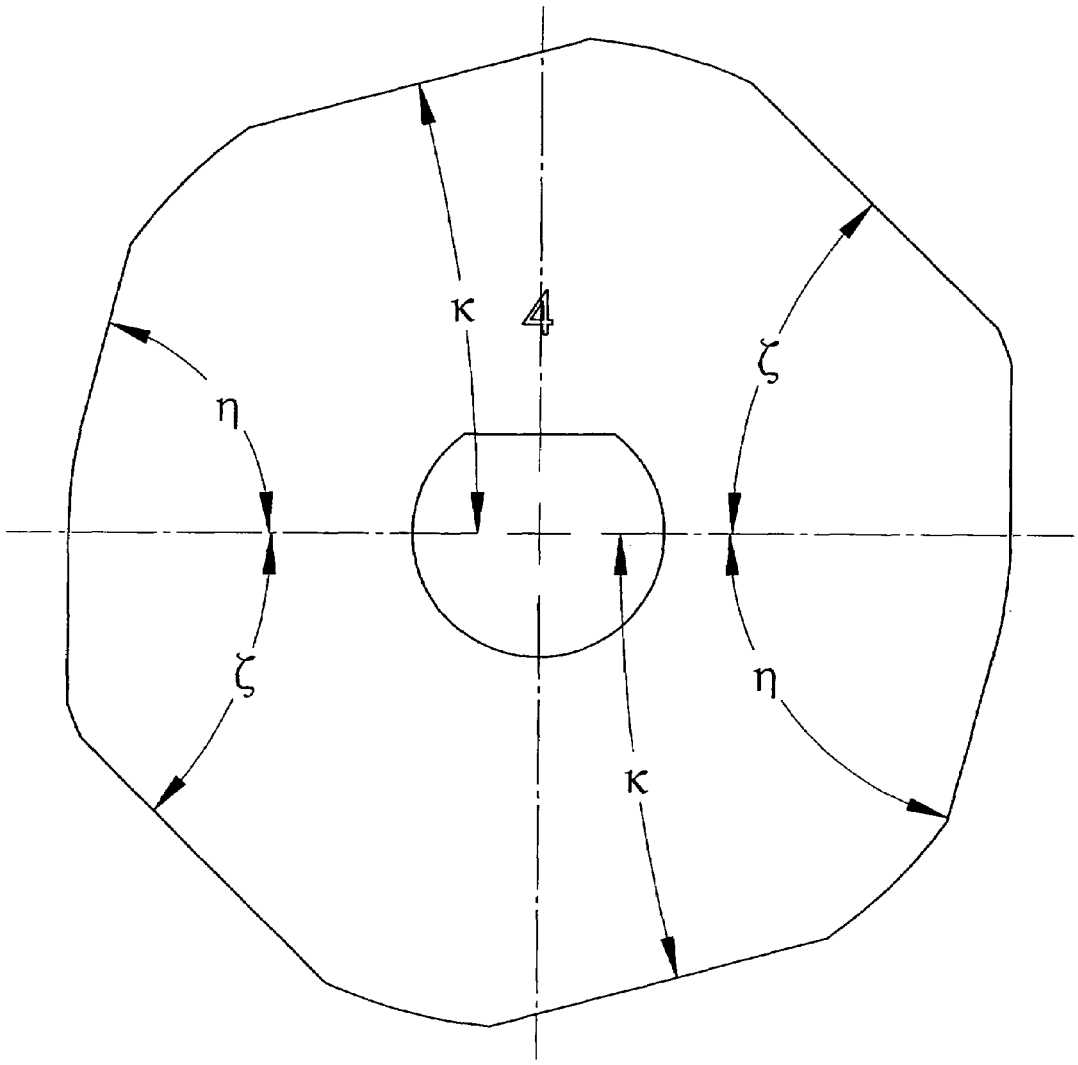
FIG. 14 is a drawing of the equal size of cam 4 and is prepared in light of the current invention.
Figure 15:
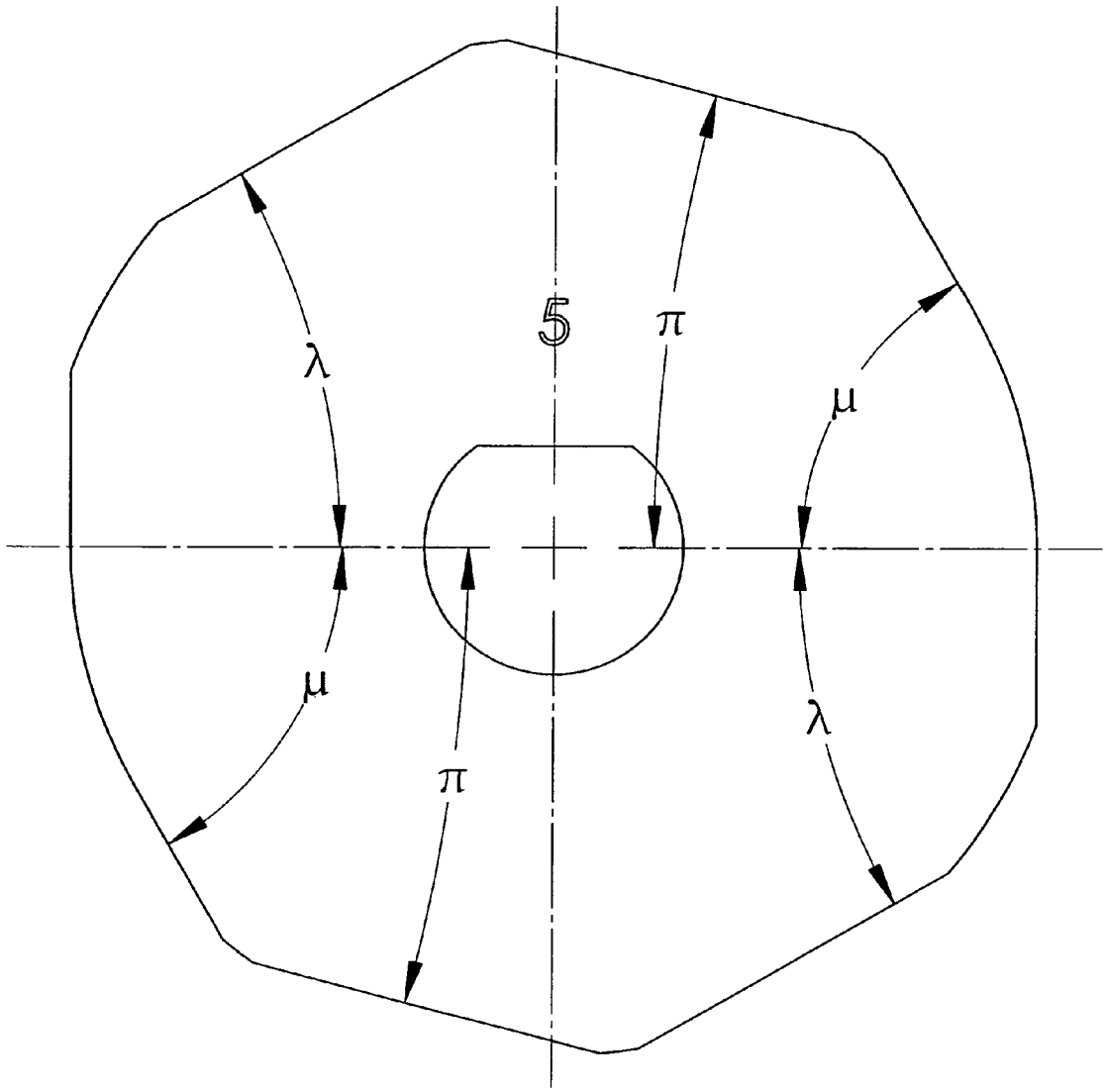
FIG. 15 is a drawing of the equal size of cam 5 and is prepared in light of the current invention.
Figure 36:
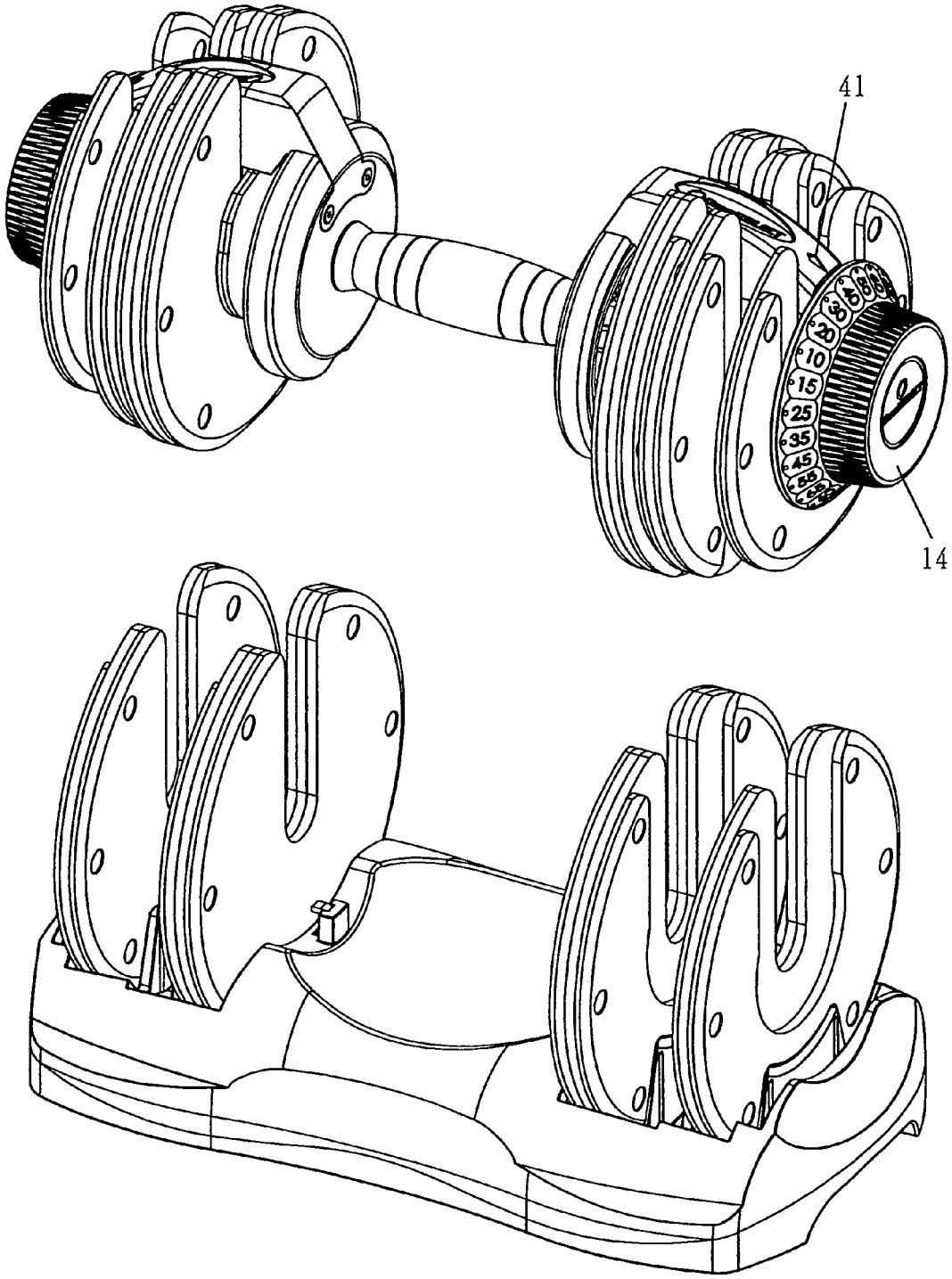
FIG. 36 is a 3D view of partial dumbbell sheets when the adjustable dumbbell is lifted from the dumbbell tray.
Figure 37:
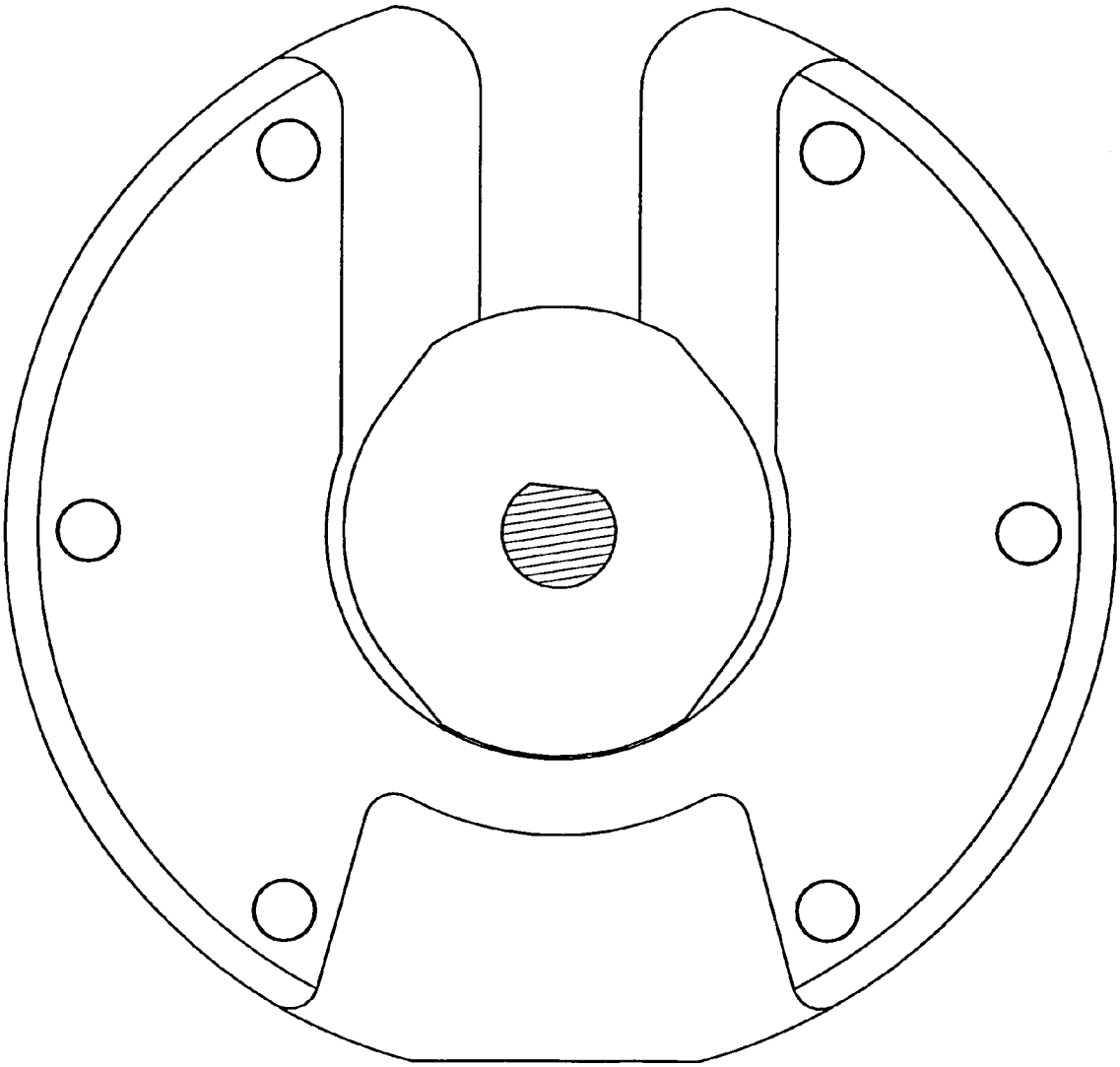
FIG. 37 is a position exploded drawing when the cam is not blocked by the dumbbell sheets.
Figure 38:
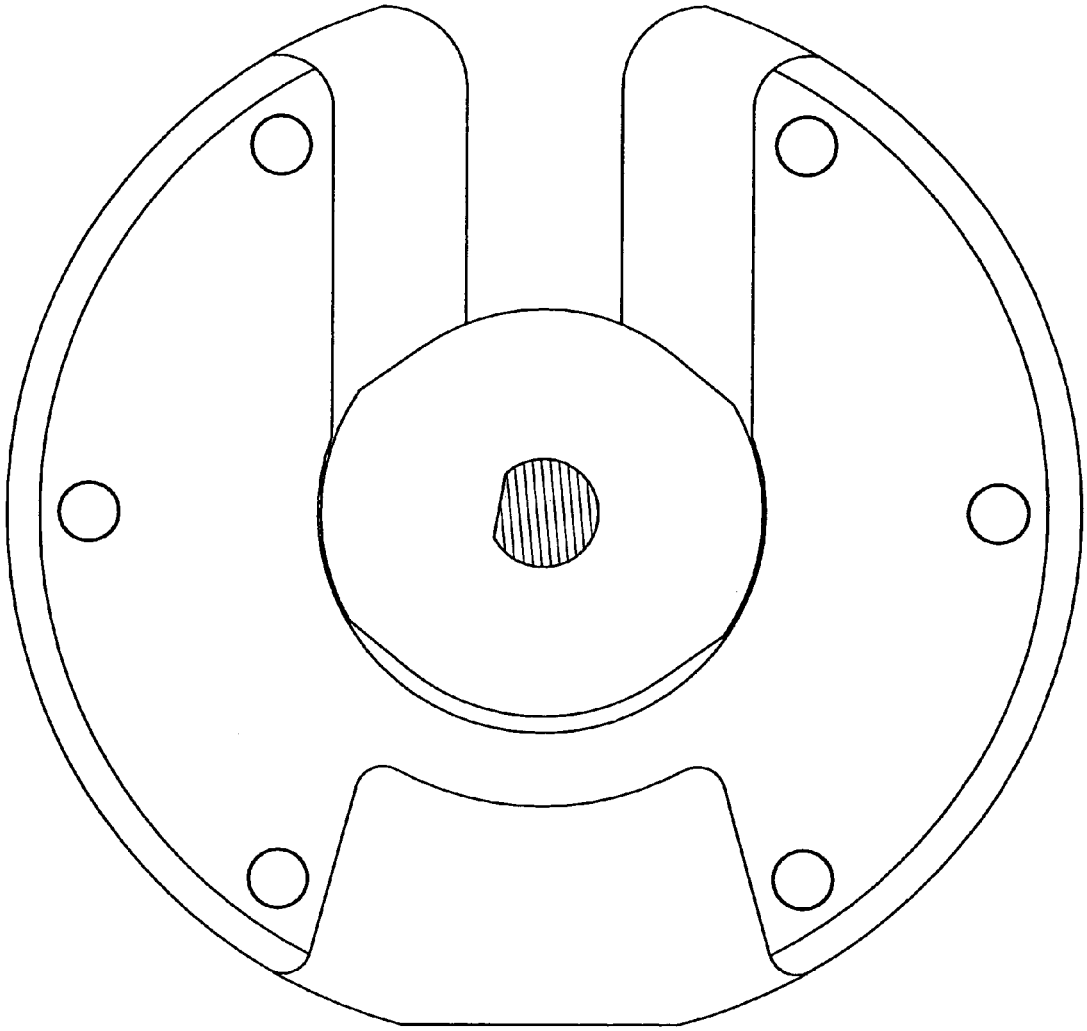
FIG. 38 is a position exploded drawing when the cam is blocked by the dumbbell sheets. It shows the operating principle for the weight adjustment of the adjustable dumbbell.

FIG. 8 is a drawing of the equal size of the cam bit. The oblate holes 5 of the cam bits inserts into the oblate bodies at the two ends of the handle 3, so as to make the cam bits at the two ends integrated as a whole to receive the handle's rotation. The edges of the cam bits have couples of convex sides such as 25*a*, 25*b*, 25*c*, 25*a*', 25*b*' and 25*c*' and some concave sides such as 26*a*, 26*b*, 26*c*, 26*a*', 26*b*' and 26*c*'. On a circumference, the convex sides are higher than the concave sides; wherein, the convex sides, such as 25*a* and 25*a*', are symmetrical correspondingly, and the opposite sides of the concave sides, such as 26*a* and 26*a*', are parallel. As shown in FIG. 9 and FIG. 10, the open slots 27 of the dumbbell sheets are larger than the parallel edge by 1 mm, the round hole 26 is larger than the convex sides by 1 mm, and the convex sides are larger than the open slots by 4 mm. When the cam is positioned at some angle, the concave sides may insert from the open slots till the bearing surfaces 32 of the side covers 20 contact the lug boss plane 29 of the dumbbell support. See FIG. 36. At this time, the circumference of the cam is concentric with the round holes of the dumbbell sheets, and the cam can realize rotation of 360 to the most at such position; and when the cam rotates to some angle, the concave sides stagger from and are blocked by the open slots because the convex sides are larger than the open slots. See FIG. 3. By then, users may lift the dumbbell sheets while lifting the dumbbell rod.

FIG. 9 and FIG. 10 are the front view and cutaway view of the dumbbell sheets respectively.

Figure 35:
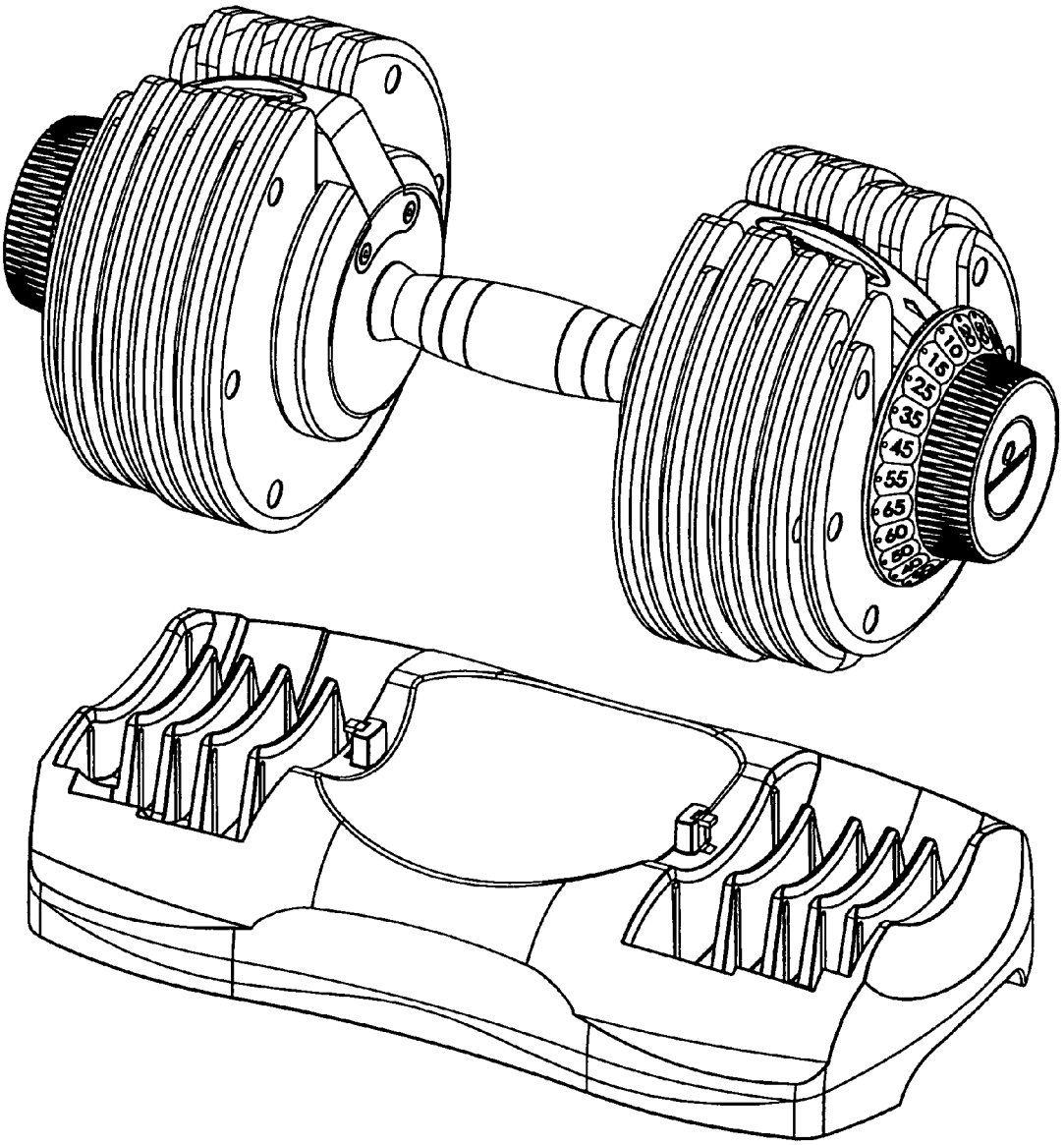
FIG. 35 is a 3D view of the lifting course of the adjustable dumbbell from the dumbbell tray.

FIG. 11, FIG. 12, FIG. 13, FIG. 14 and FIG. 15 show the cam bits of five different specifications. As the different lifting weights of the adjustable dumbbell are determined by the dumbbell sheets of different specifications and quantity. See FIG. 35 and FIG. 36, the cam bits of the five different specifications mutually differ in terms of convex side quantity, size and positions and angles.

Figure 16:
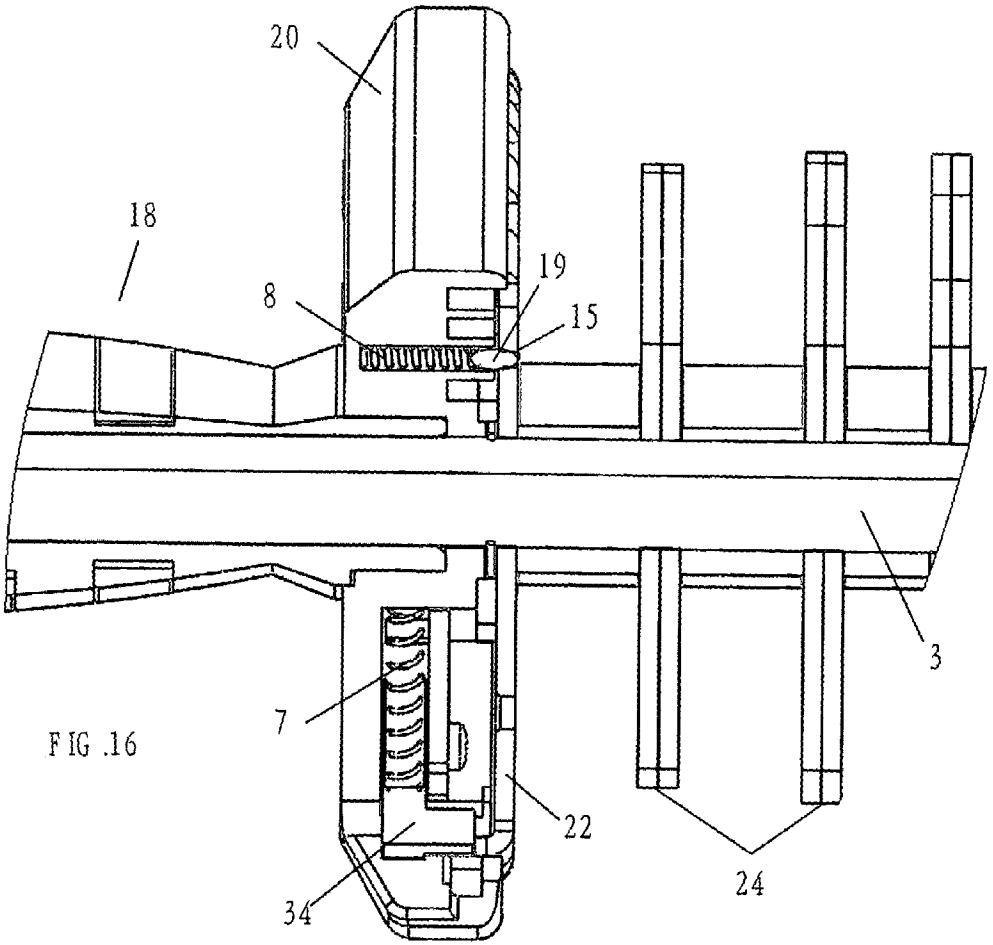
FIG. 16 is partial cutaway view of the dumbbell bar and is prepared in light of the current invention.

FIG. 16 is a partial cutaway view of the dumbbell rod, mainly instructing the locking principle of the safety locks of the dumbbell rod. The safety locks, under the pushing of an internal spring 7, slide out and insert into the open slots 11 of the dowel discs 22, through which to make the dowel discs, the cam and the dumbbell handwheels all under a locking status. At this time, the ball bearings 19 are sink to the round hole 15 of each dowel disc, under the pushing force of the spring 8.

Figure 17:
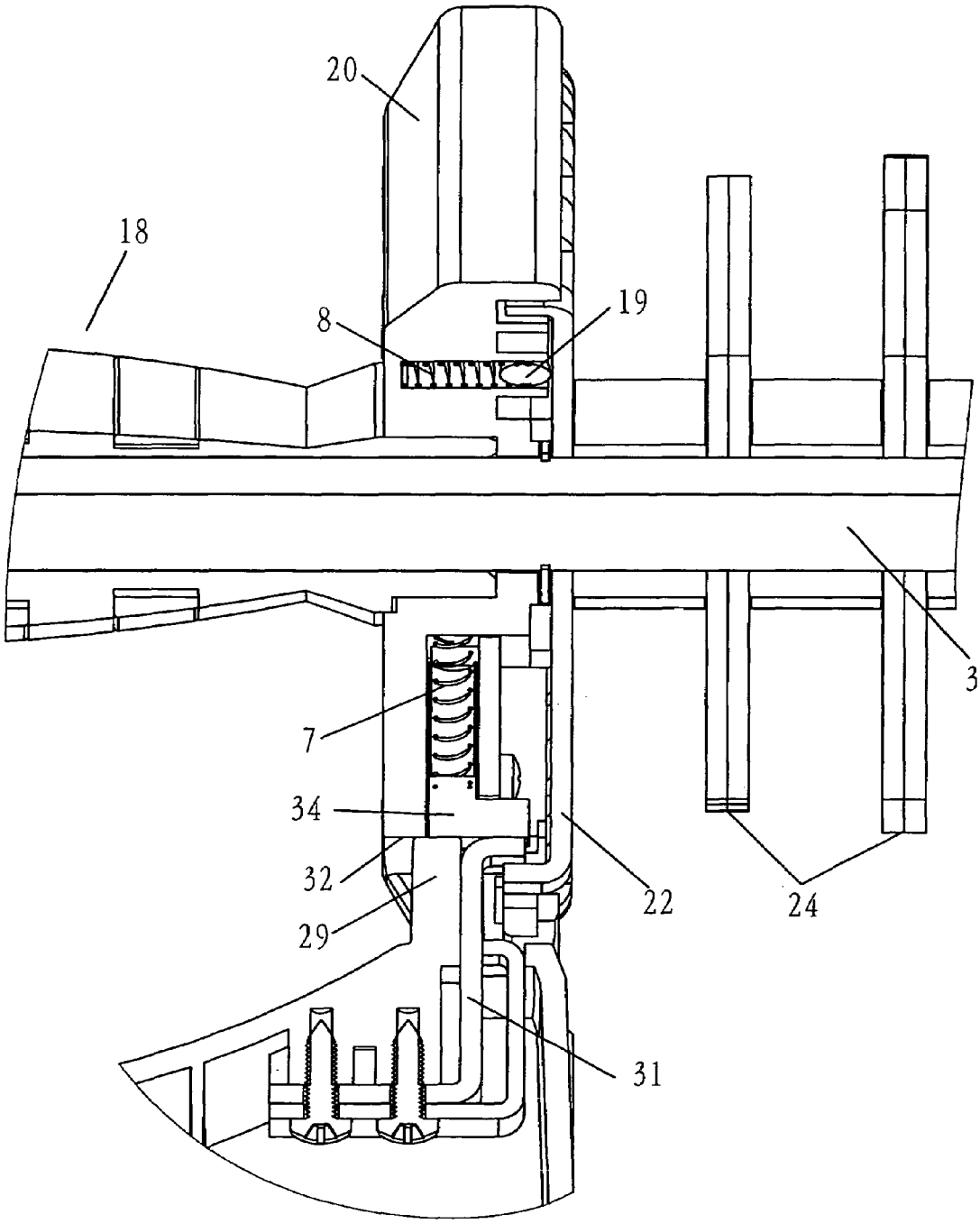
FIG. 17 is a partial cutaway view of the dumbbell bar and the dumbbell tray when they are combined, showing the internal structure and the mechanism of the safety locks.

FIG. 17 is a partial cutaway view of the dumbbell rod and the dumbbell tray when they are combined, mainly instructing the locking principle of the safety locks during such combination. According to the partial cutaway view, the lug boss planes and the latch hooks eject the safety locks in the side covers from the open slots of the dowel slots to the side covers' table-boards 32, one ends of the latch hooks are positioned in the dowel disc, at this time, the dowel discs may undergo rotation of 360 degrees to the most.

When the weight gear is chosen correctly, one ends of the latch hooks 31 will be dead against the open slots 11 of the dowel discs, at this time, the dumbbell rod may be lifted; and when the weight gear is not chosen correctly, one ends of the latch hooks 31 will be stagger from open slots and get connected with the hook, at this time, the dumbbell rod forms as a whole with the dumbbell tray and therefore cannot be lifted, aiming at preventing users from the dangers caused by the dropped dumbbell sheets in the use due to deficiently firm combination of the dumbbell rod and the dumbbell sheets as a result of the application of an incorrect gear, or to say the dumbbell rod is not locked.

When the handwheels are rotated, the ball bearings 19 will roll on the circumference of the round holes 15 of the dowel discs. The ball bearings will produce "click" sound when sinking to the round holes 15, promoting the correct weight gear has been chosen from hearing aspect. When being pushed out from the round holes, the ball bearings will show some damping under the action of the spring 8. The weight gear adjustment at this time will produce some hand feeling.

Figure 25:
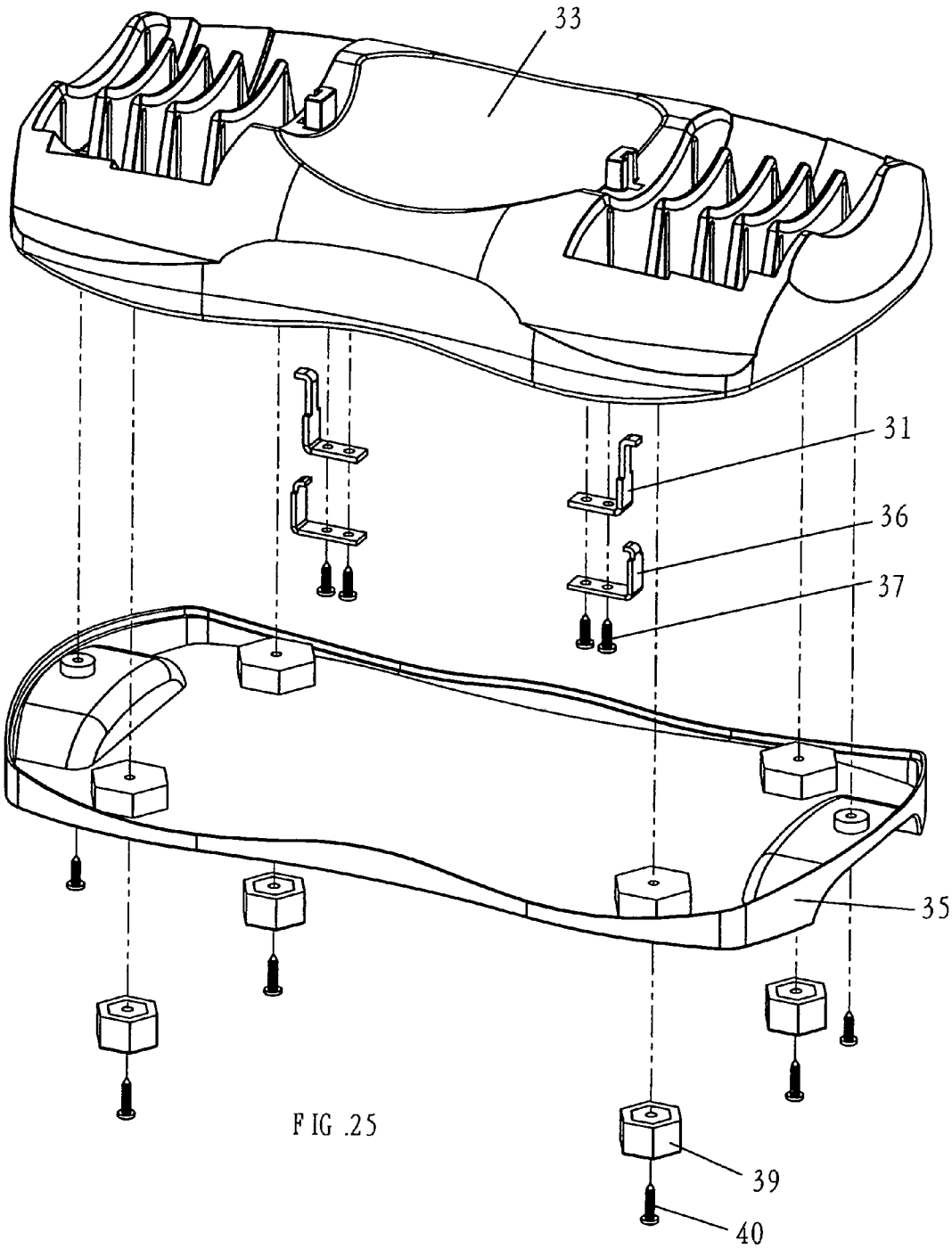
FIG. 25 is an exploded drawing of the dumbbell tray and mounting assemblies.
Figure 27:
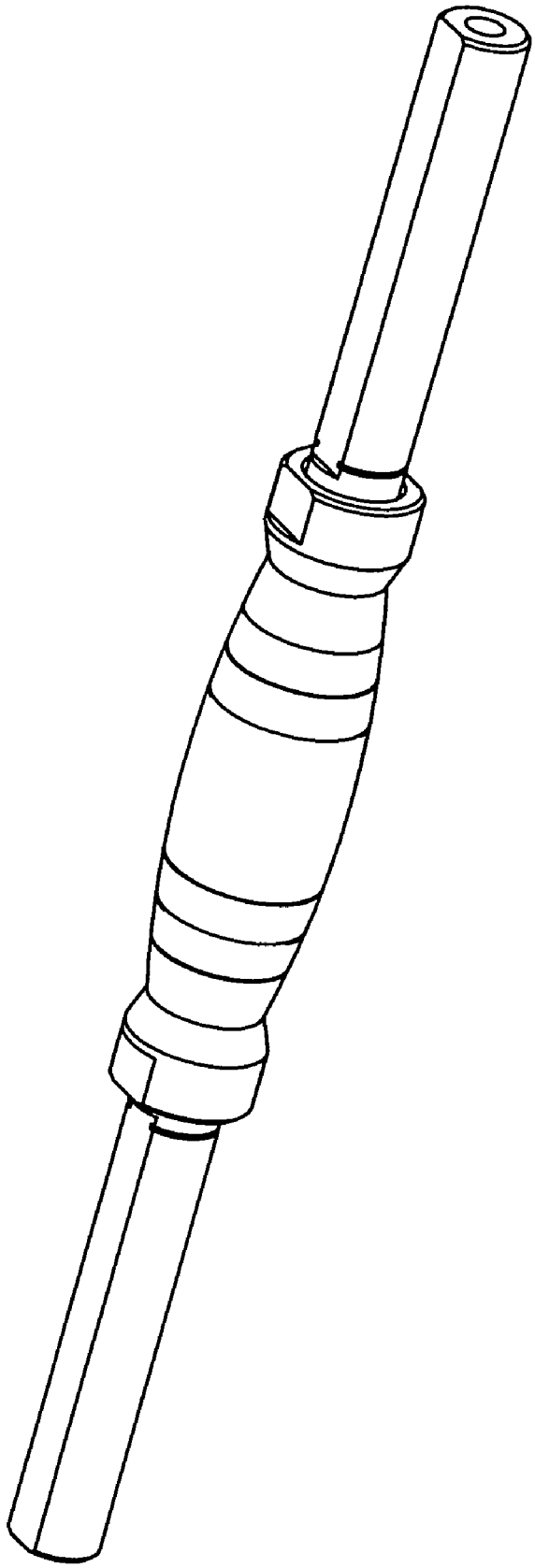
FIG. 27 is a 3D view of the grip and mandrel and is prepared in light of the current invention.
Figure 28:
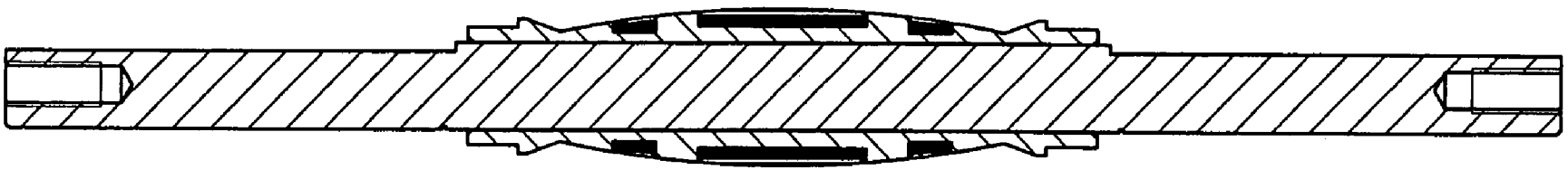
FIG. 28 is a front cutaway view of FIG. 27.

FIG. 25 is the exploded view of the dumbbell tray which comprises an upper cover 33, latch hooks 31, a compressing hook 36, a bottom cover 35 and a pad 39. A bolt 37 fixes both compressing hook and latch hooks onto the upper cover, and a bolt 40 combines the bottom cover and the upper cover into a whole by means of the hex bolt pad 39.

FIG. 26 is the actual drawing of the dumbbell handwheels. The circumference on the inclined plane is embedded with different numerical values. One of the numerical value subtends the indicator signs 41 of the bridge-shaped block 11. See FIG. 34 and FIG. 36, indicating that such numerical value is the weight at the lifting of the dumbbell.

Figure 39:
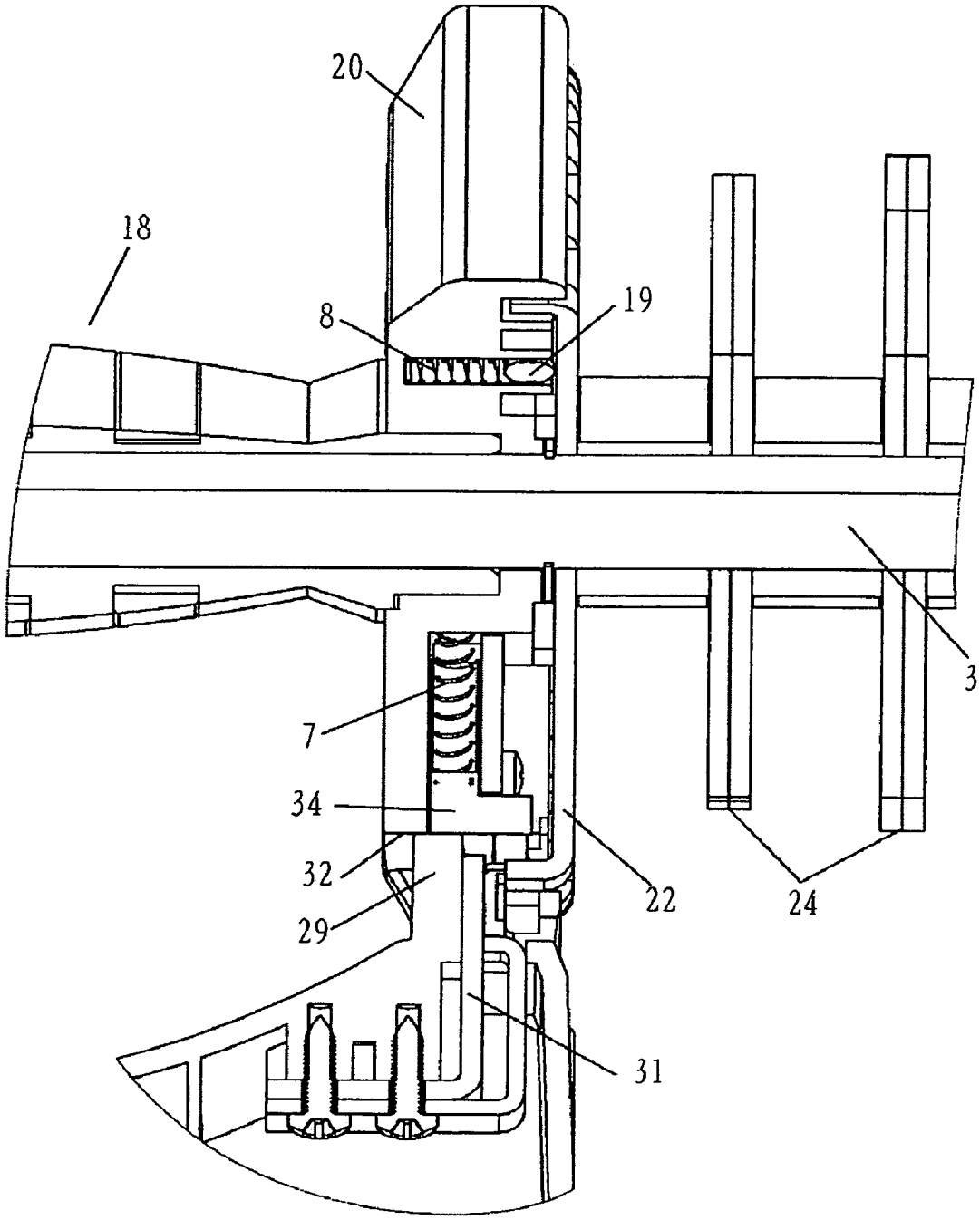
FIG. 39 is an illustration of an alternate embodiment of the invention.
Figure 40:
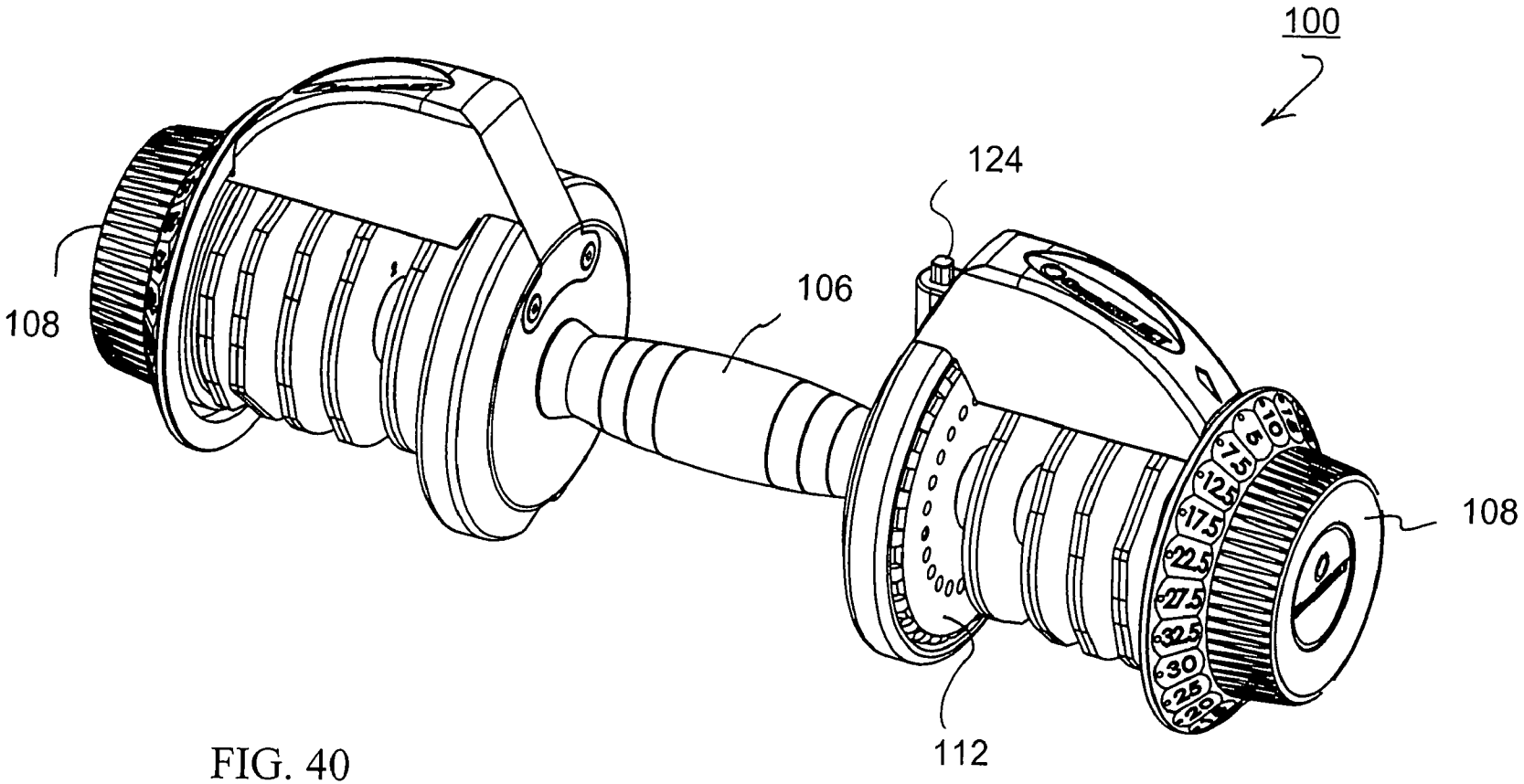
FIG. 40 is a perspective illustration of the preferred embodiment of the invention.
Figure 41:
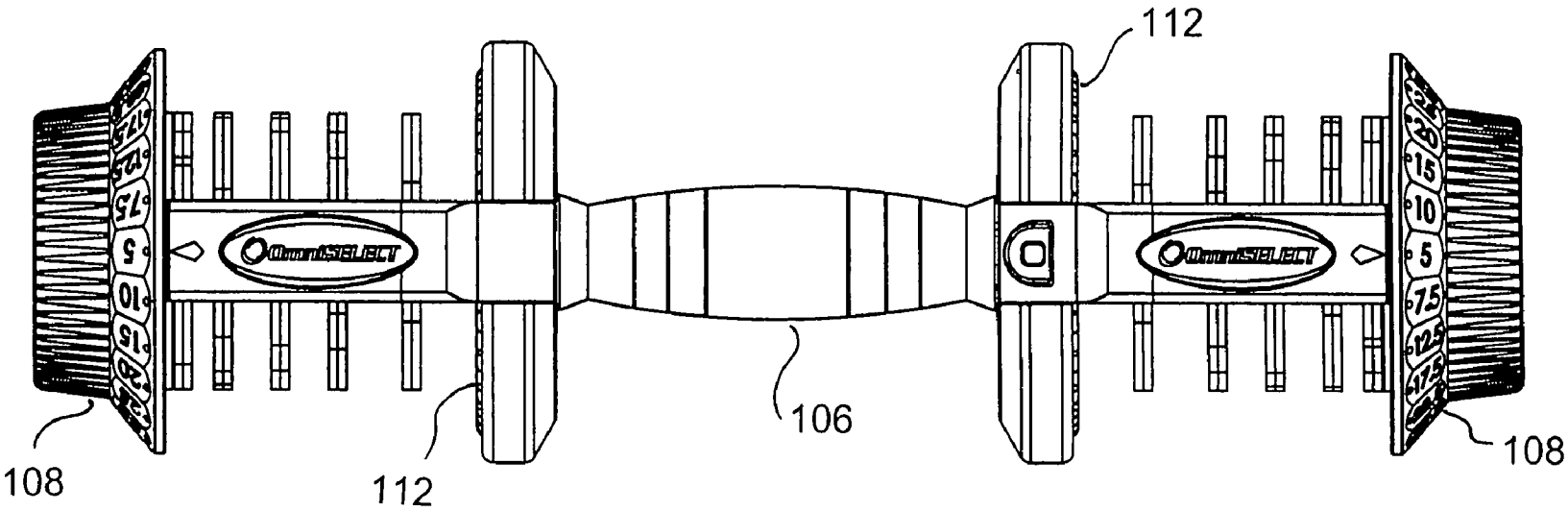
FIGS. 41, 42 and 43 are plan, side elevational and end elevational views of the embodiment of FIG. 40.
Figure 42:
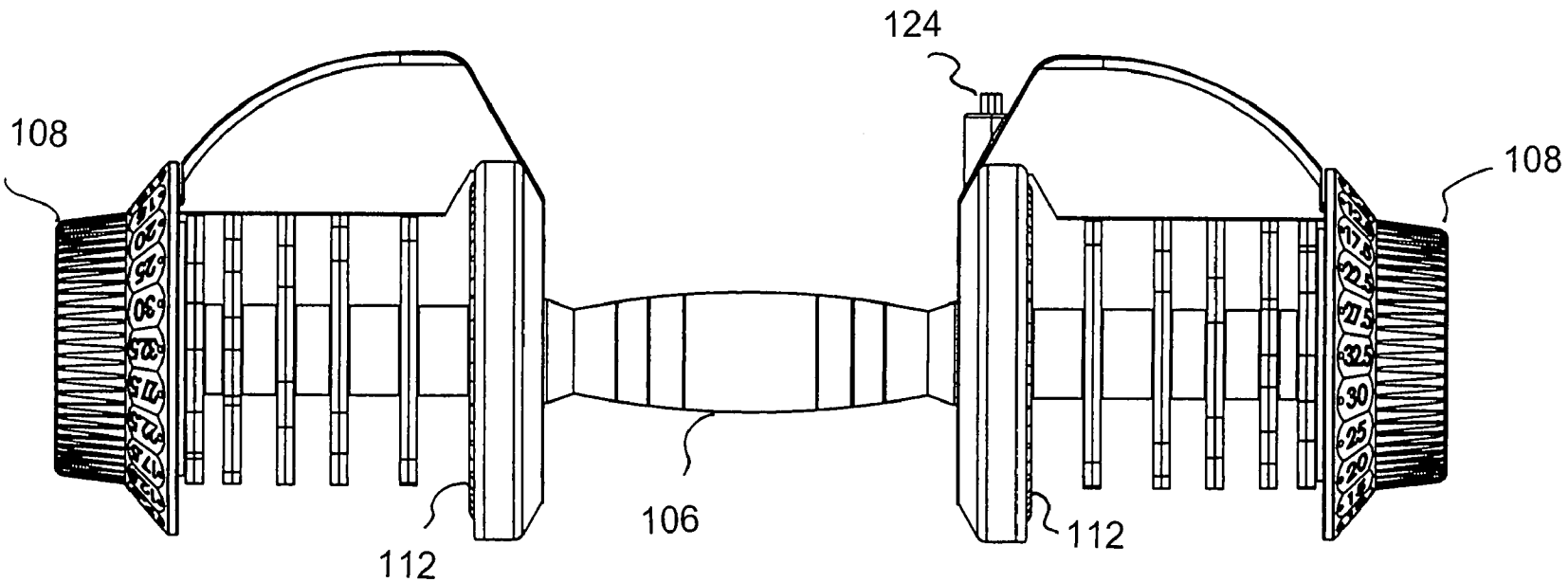
Figure 43:
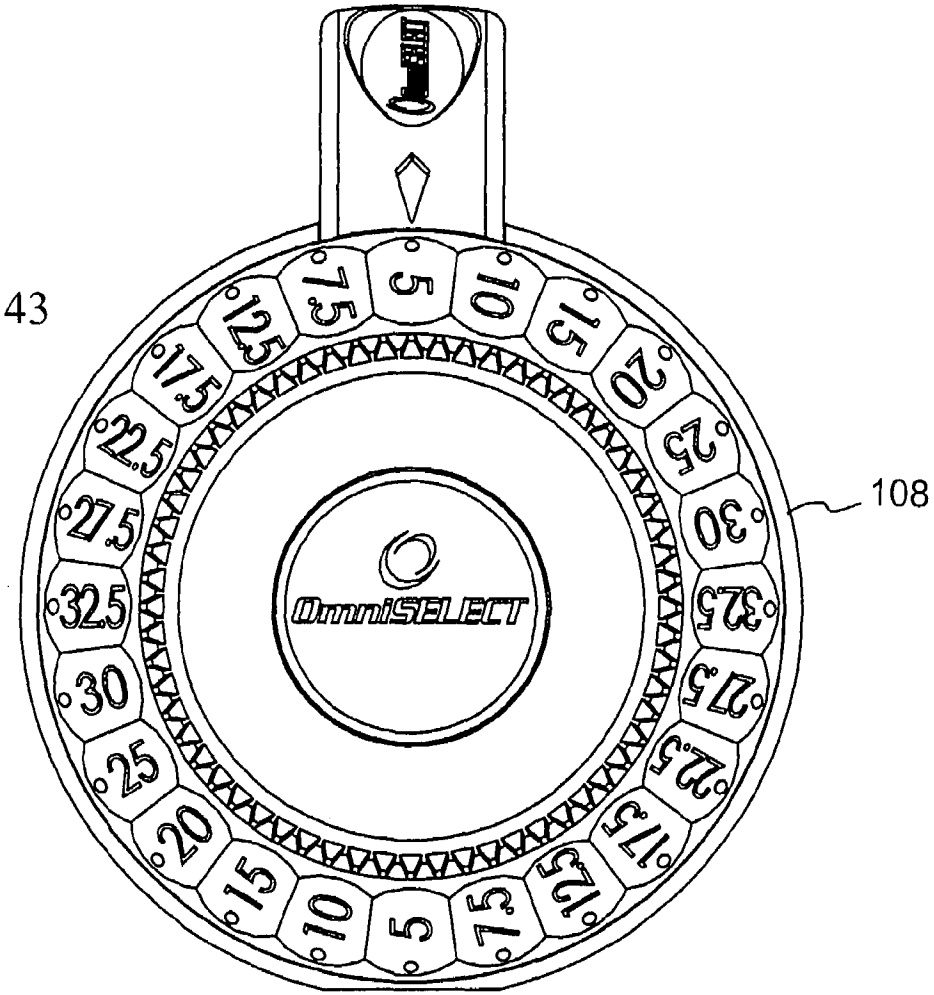
Figure 44:
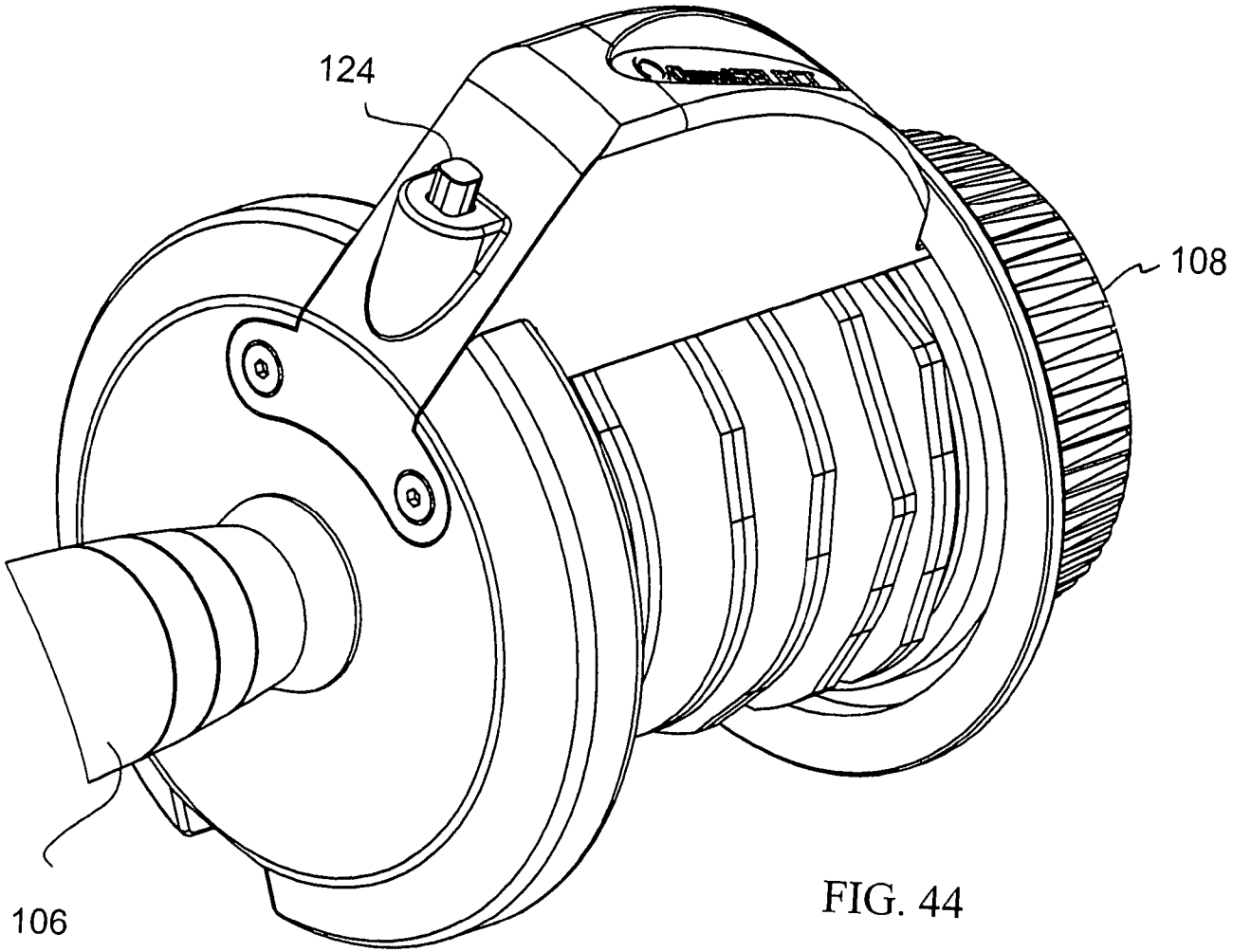
FIG. 44 is an enlarged perspective illustration of a portion of the preferred embodiment.
Figure 45:
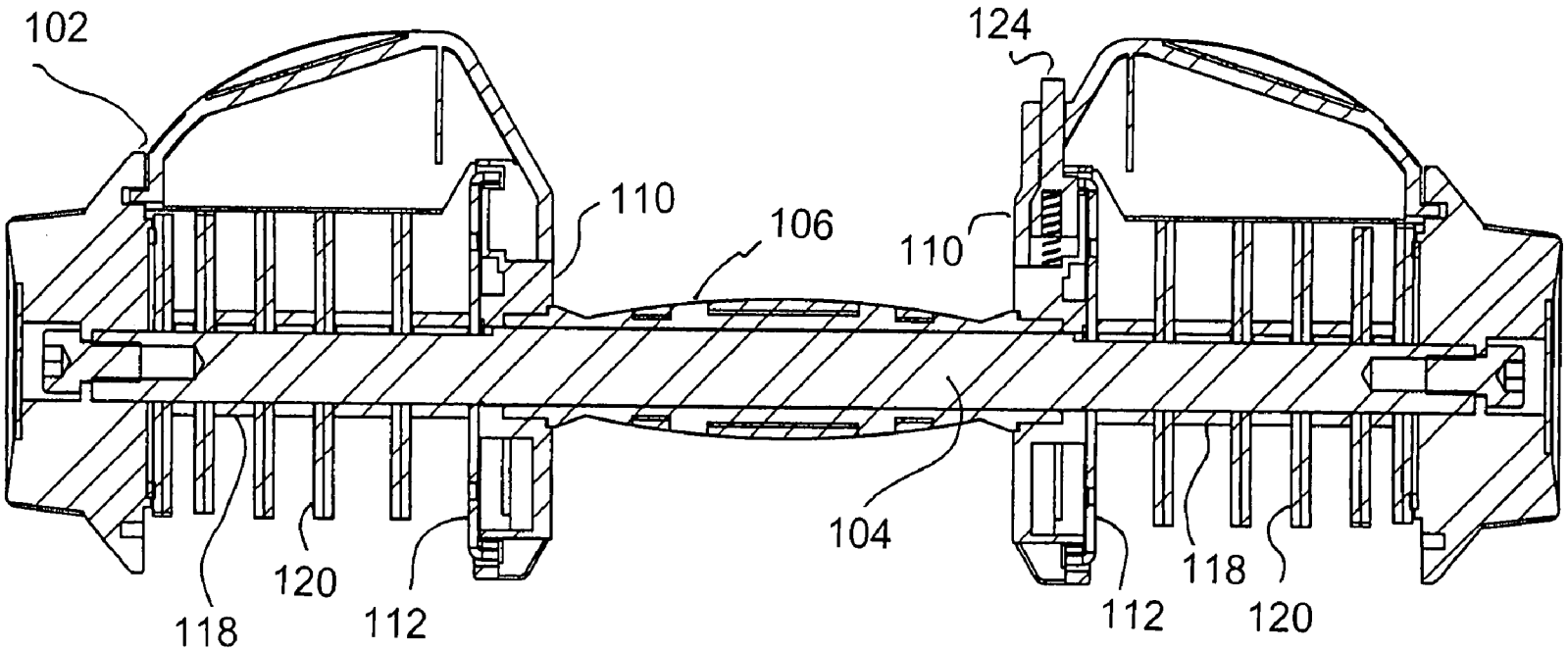
FIG. 45 is a cross sectional view through the axis of the preferred embodiment.
Figure 46:
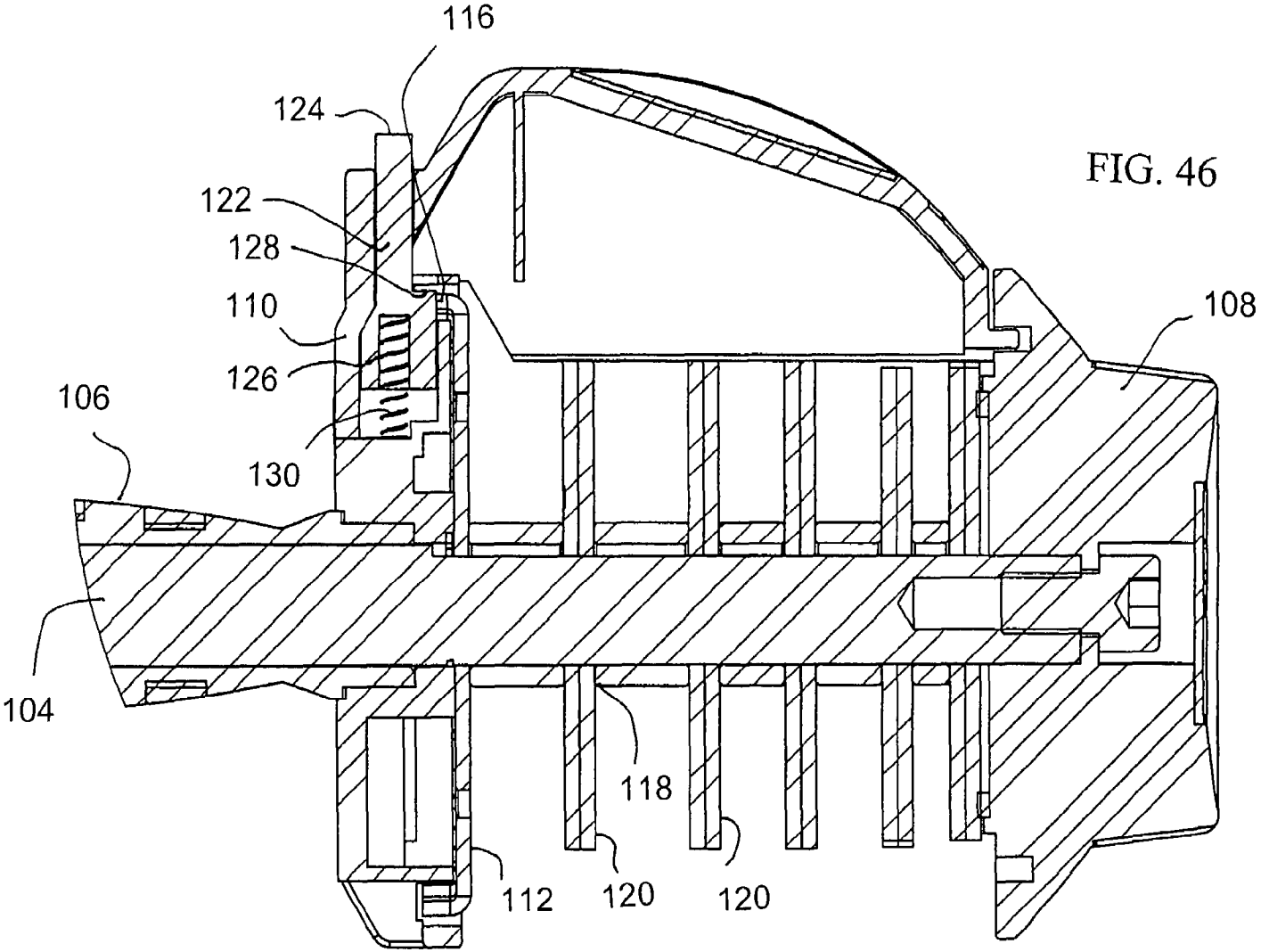
FIGS. 46 and 47 are enlarged cross sectional views of the system taken through the safety lock and adjacent components showing the raised locked orientation and the lowered unlocked orientation.
Figure 47:
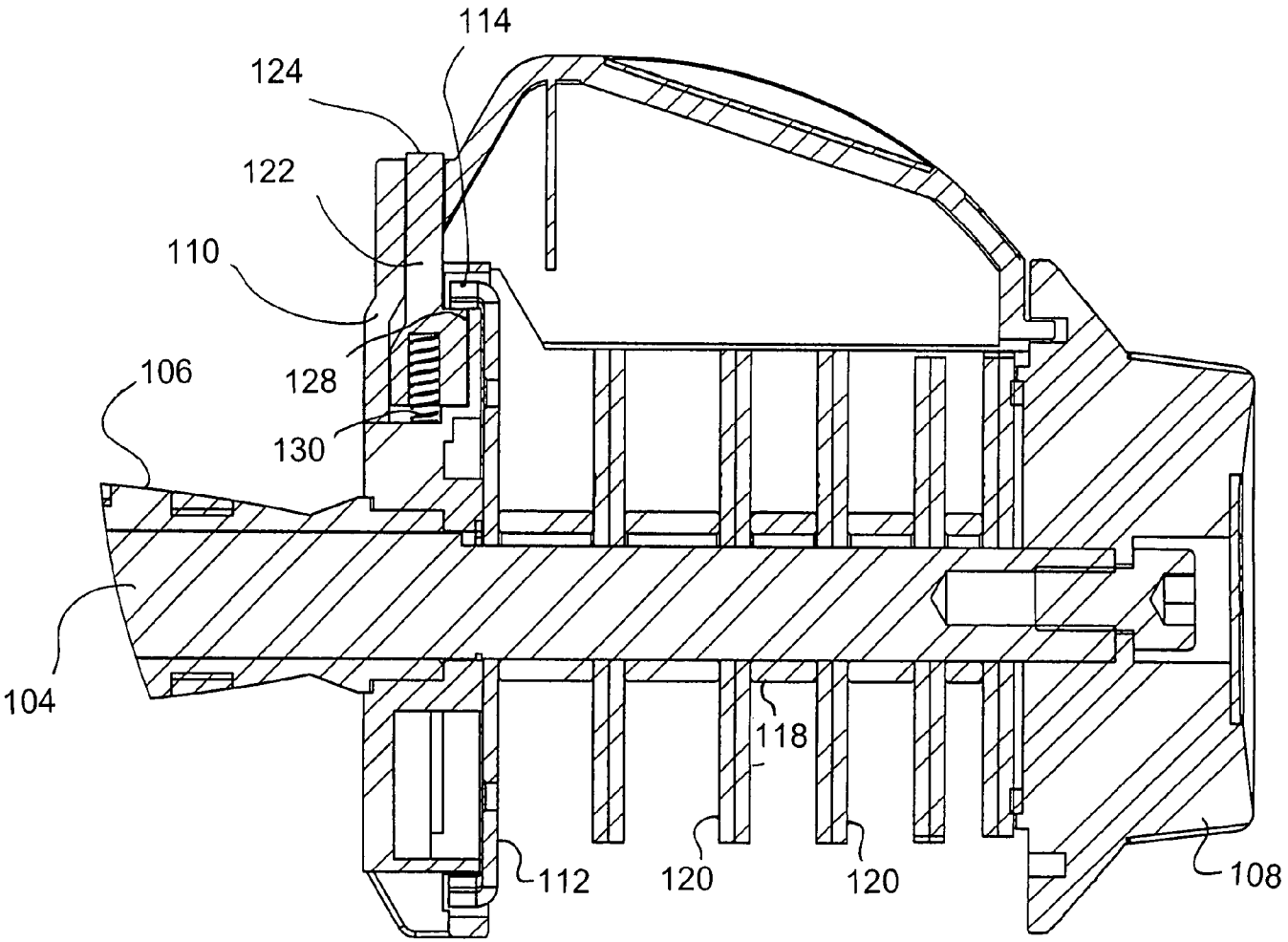

FIG. 39 illustrates an alternate embodiment of the invention in which the system 100 is shown. In this embodiment, the outwardly extending fingers of the upstanding components of the tray are eliminated. In such embodiment, the fingers of the dowel disks have a width of about 5 mm with a spacing of about 8 mm between the fingers and the safety lock has a width of 4.5 mm. Further, the width of the safety lock is about 25 percent less than the spaces between the fingers.

The preferred embodiment of the invention is illustrated in FIGS. 40 through 47. The adjustable dumbbell system is for selectively varying the weight to be lifted by a user. Such selective varying is done in a safe, convenient and economical manner. The system comprises a dumbbell 102 having a handle 104 in a cylindrical configuration with a central axis. The handle has opposed ends and a central extent. A tubular grip 106 with opposed ends rotationally receives the central extent of the handle. An adjustment wheel 108 is secured to each end of the handle for rotating the handle with respect to the grip. A side cover 110 is fixedly secured to each end of the grip, a dowel disk 112 is rotatably supported on the handle adjacent to one side cover. The dowel disk has radially extending fingers 114 each about 5 mm in width equally spaced from the central axis with spaces 116 each about 8 mm in width between the fingers. A plurality of cam bits 118 are supported on the handle between the side covers and the adjustment wheels, the cam bits are secured on each side of the side covers for concurrent rotation with the handle.

Provided next are a plurality of weights 120, one weight for each cam bit. The weights and the cam bits as well as their coupling and uncoupling are preferably the same as in the prior embodiments. Each weight has openings and each cam bit has a cam surface whereby the weights are adapted to attach to and release from an associated cam bit as a function of the rotational orientation of the shaft and adjustment wheels. Each weight has a central primary aperture and primary slot. Each weight has a major section and an axially offset secondary minor section. The minor section is formed with a secondary aperture and a secondary slot. Each cam plate includes an irregularly shaped polygon with radially enlarged sections providing cam surfaces at maximum radii greater than the radii of the remainder of the cam plate. The radially enlarged sections are adapted to releasably couple selectively with the secondary aperture of the weights.

Lastly, a safety lock 122 is radially positioned for reciprocable movement within the side cover adjacent to the dowel disk. The safety lock has an upper extent 124 with an exposed button and a lower extent with a radial recess 126 and a central extent with an axial projection 128. The axial projection is about 4.5 mm in width. A coil spring 130 is within the radial recess and urges the safety lock upwardly and radially outwardly. The safety lock is movable between a raised locked orientation and a lowered unlocked orientation.

The safety lock when in the raised locked orientation positions the axial projection in a space between adjacent fingers of the dowel disk for allowing only limited rotation of the dowel disk, cam bits, handle and adjustment disks with respect to the side covers, safety lock and grip. In this manner, the user may not change the weight to be lifted with the lifting of the dumbbell. The safety lock when in the lowered unlocked orientation positions the axial projection radially spaced from the fingers and spaces of the dowel disk for allowing full rotation between the dowel disk, cam bits, handle and adjustment disks with respect to the side covers, safety lock and grip. In this manner, the user may change the weight to be lifted with the lifting of the dumbbell. Note is taken that a safety feature is provided when changing from the lowered unlocked orientation to the raised locked orientation. If the adjustment wheels are not correctly rotated whereby the weights are safely engaged, the spring will not return the safety lock to the raised locked orientation since one of the fingers will be blocking the upward movement of the lateral projection of the safety lock.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An adjustable dumbbell system comprising:

a dumbbell having a handle having opposed ends and a central extent, a grip rotationally receiving the central extent of the handle, an adjustment wheel secured to each end of the handle, a side cover fixedly secured to each end of the grip, a dowel disk on the handle adjacent to one side cover with fingers and spaces, a plurality of cam bits supported on the handle;

a safety lock within the side cover adjacent to the dowel disk, the safety lock having a first end extent and a second end extent with a radial recess and a central extent with an axial projection, a coil spring within the radial recess urging the safety lock radially outwardly; and a plurality of weights, one weight for each cam bit, each weight having openings and each cam bit having a cam surface whereby the weights are adapted to attach to and release from an associated cam bit as a function of the rotational orientation of the shaft and adjustment wheels, each weight having a central primary aperture and primary slot, each weight having a major section and an axially offset secondary minor section, the minor section being formed with a secondary aperture and a secondary slot and wherein each cam plate includes an irregularly shaped polygon with radially enlarged sections providing cam surfaces at maximum radii greater than the radii of the remainder of the cam bit, the radially enlarged sections adapted to releasably couple selectively with the secondary aperture of the weights.

2. The system as set forth in claim 1 and further including:

a base for receiving a dumbbell with its weights, the base including an upstanding vertical component for moving the safety lock between the locked orientation and the unlocked orientation.

3. The system as set forth in claim 2 and further including a laterally extending horizontal component for locking the dumbbell t6 the base when the safety lock in not vertically aligned with a space between fingers of the dowel disk.

4. An adjustable dumbbell system for selectively varying the weight to be lifted by a user, such selective varying being done in a safe, convenient and economical manner, the system comprising, in combination:

a dumbbell having a handle in a cylindrical configuration with a central axis, the handle having opposed ends and a central extent, a tubular grip with opposed ends rotationally receiving the central extent of the handle, an adjustment wheel secured to each end of the handle for rotating the handle with respect to the grip, a side cover fixedly secured to each end of the grip, a dowel disk rotatably supported on the handle adjacent to one side cover, the dowel disk having radially extending fingers each about 5 mm in width equally spaced from the central axis with spaces each about 8 mm in width between the fingers, a plurality of cam bits supported on the handle between the side covers and the adjustment wheels, the cam bits being secured on each side of the side covers for concurrent rotation with the handle;

a plurality of weights, one weight for each cam bit, each weight having openings and each cam bit having a cam surface whereby the weights are adapted to attach to and release from an associated cam bit as a function of the rotational orientation of the shaft and adjustment wheels, each weight having a central primary aperture and primary slot, each weight having a major section and an axially offset secondary minor section, the minor section being formed with a secondary aperture and a secondary slot and wherein each cam plate includes an irregularly shaped polygon with radially enlarged sections providing cam surfaces at maximum radii greater than the radii of the remainder of the cam bit, the radially enlarged sections adapted to releasably couple selectively with the secondary aperture of the weights; and a safety lock radially positioned for reciprocable movement within the side cover adjacent to the dowel disk, the safety lock having an upper extent with an exposed button and a lower extent with a radial recess and a central extent with an axial projection, the axial projection being about 4.5 mm in width, a coil spring within the radial recess urging the safety lock upwardly and radially outwardly, the safety lock movable between a raised locked orientation and a lowered unlocked orientation, the safety lock when in the raised locked orientation positioning the axial projection in a space between adjacent fingers of the dowel disk for allowing only limited rotation of the dowel disk, cam bits, handle and adjustment disks with respect to the side covers, safety lock and grip whereby the user may not change the weight to be lifted with the lifting of the dumbbell, the safety lock when in the lowered unlocked orientation positioning the axial projection radially spaced from the fingers and spaces of the dowel disk for allowing full rotation between the dowel disk, cam bits, handle and adjustment disks with respect to the side covers, safety lock and grip whereby the user may change the weight to be lifted with the lifting of the dumbbell.

* * * * *